United States Patent [19]

Koshimizu et al.

[11] Patent Number: 4,820,623

[45] Date of Patent: Apr. 11, 1989

[54] METHOD FOR PROCESSING SILVER HALIDE COLOR PHOTOGRAPHIC MATERIAL

[75] Inventors: Toshio Koshimizu; Keiji Mihayashi, both of Kanagawa, Japan

[73] Assignee: Fuji Photo Film Co., Ltd., Kanagawa, Japan

[21] Appl. No.: 151,848

[22] Filed: Feb. 3, 1988

[30] Foreign Application Priority Data

Feb. 4, 1987 [JP] Japan ..... 62-24377

[51] Int. Cl.[4] ..... G03C 1/08; G03C 5/24; G03C 7/26; G03C 7/32

[52] U.S. Cl. ..... 430/376; 430/398; 430/399; 430/428; 430/474; 430/490; 430/491; 430/554; 430/555; 430/558

[58] Field of Search ..... 430/376, 428, 474, 490, 430/491, 398, 399, 554, 555, 558

[56] References Cited

U.S. PATENT DOCUMENTS 4,012,258 5/1977 Kojima et al. ..... 430/376
4,745,048 5/1988 Kishimoto et al. ..... 430/376

OTHER PUBLICATIONS

M. R. V. Sahuun, "Some Aspects of Diffusion Transfer Chemistry", *Journal of Applied Phy., Exp. 5: 32–35, (1979).*

M. Tashiro et al., "Application of Electrodialysis to Developer Reuse in ME-4 Process", *Journal of App. Phy.,* Exp. 5: 208–215, (1979).

*Primary Examiner*—Mukund J. Shad
*Attorney, Agent, or Firm*—Sughrue, Mion, Zinn, Macpeak & Seas

[57] ABSTRACT

A method for processing a silver halide color photographic material comprising a support having thereon at least one silver halide emulsion layer and containing a magenta dye forming coupler represented by formula (I) shown below and a compound represented by formula (II) shown below in the same layer is described, wherein the silver halide color photographic material is subjected to color development using a replenisher for a color developing solution, whose concentration of bromide is not more than $3\times10^{-3}$ mol per liter and the amount of the replenisher for a color developing solution is not more than 900 ml per $m^2$ of the silver halide color photographic material, wherein (I)

wherein $R_1$ represents an aromatic group, an aliphatic group or a heterocyclic group; $R_2$ represents a substituent; Za, Zb, Zc and Zd, which may be the same or different, each represents an unsubstituted methine group, a substituted methine group or —N=; and formula (II) is represented by $$(R'\text{—}COO^-)_n M^{n+} \quad \text{(III)}$$

wherein R' represents a substituent which imparts a diffusion-resistant property to the compound represented by formula (II); $M^{n+}$ represents a hydrogen ion, a metal ion or an ammonium ion; and n represents an integer from 1 to 4.

According to the method of the present invention, the amount of replenisher for a color developing solution can be reduced without adverse affects on photographic properties. Further, the formation of precipitates in the color developing solution is prevented and adhesion of scum onto the photographic material does not occur.

17 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material, and more particularly to a method for processing a silver halide color photographic material wherein the amount of a replenisher required for a color developing solution is reduced.

BACKGROUND OF THE INVENTION

In general, color photographic images can be formed by color development of a photographic light-sensitive material, after imagewise exposure, with a color developing solution containing an aromatic primary amine developing agent such as a p-phenylenediamine, etc., followed by bleaching, fixing and washing with water, etc. For the purpose of conducting a rapid processing, a bleach-fixing step in which a bleaching step and a fixing step are simultaneously carried out is also known.

In recent years, environmental conservation, saving and recovering of water resources and silver resources have been regarded as important in processing method wherein color photographic processing is conducted automatically and continuously, and thus methods for preventing environmental pollution, methods for efficiently recovering silver, and methods for reduction and reuse of washing with water have been strongly desired.

Further, from a standpoint of simplification of processing method, it has been also strongly desired to conduct a method in which an amount of replenisher for processing solution is small in a development processing step using a replenishment system.

The amount of replenishment for a developing solution in a continuous development processing can be somewhat varied depending on kinds of photographic light-sensitive materials to be processed. However, it is usually in a range from about 1100 ml to 1300 ml per $m^2$ in the case of silver halide color photographic materials for photographing.

It has been desired to reduce the amount of replenishment required from the viewpoint described above. However, the reduction of the amount of replenishment is generally very difficult to achieve since the reduction leads to deterioration of photographic properties.

On the other hand, in order to satisfy the requirement for environmental conservation, various regeneration methods of color developing solutions have been proposed in color development processing steps. Examples of such methods are described, for example, in *J. Appl. Phot. Eng.*, Vol. 5, page 208 (1979); *Gekkan Labo*, Vol. 15, page 113 (1979); *SMPTE. J.*, Vol. 88, page 165 (1979); *J. Appl. Phot. Eng.*, Vol. 5, page 32 (1974); *SMPTE. J.*, Vol. 88, page 168 (1979); and Japanese Patent Application (OPI) Nos. 143018/77, 146236/77, 149331/78 and 9629/79 (the term "OPI" as used herein means an "unexamined published application"), J. Appl. Phot. Eng., Vol. 5, page 216 (1979), etc.

Further, when the amount of replenishment is reduced, it is generally the case that substances dissolved from the silver halide photographic materials (for example, halogen ions formed as the result of decomposition of silver halide) relatively increase and thereby cause a problem of decrease in sensitivity.

Against the problem of the decrease in sensitivity, there has been attempted to reduce the amount of replenishment while preventing from the decrease in sensitivity by means of increase in processing temperature. Examples of these methods are described, for example, in a reference on processing chemicals CP-LR for color paper of Hunt Co., Ltd., specifically, *Photographic Bulletin*, No. 49, page 6, "Color Print Chemistries", published by Hunt Co., Ltd., Preprint A-7, "Reduced amount of replenishment for processing color paper" published from The Society of Photographic Science and Technology of Japan (1980), etc. The former processing chemicals can be reduced the amount of replenishment for color developing solution to a range of $\frac{1}{2}$ to $\frac{2}{3}$ of a conventional amount of replenisher.

However, these methods relate to processing for color paper and can not be immediately applied to processing of color photographic light-sensitive materials for photographing in view of photographic characteristics such as sensitivity, gradation, color reproducibility, etc.

With processing of color negative films, processing chemicals of Hunt Co., Ltd. are employed in a reduced replenishment system of 754 ml per $m^2$, as described in *Photographic Bulletin*, No. 55, published by Hunt Co., Ltd. However, stability of processing is still insufficient. It is assumed as reason of the above insufficient stability that the color photographic light-sensitive materials themselves are easy to undergo an influence due to variety of composition of a color developing solution which is accompanied by the condensation and the oxidation, and in a running process an initial concentration cannot be maintained, thereby an instable condition is produced since a concentration of bromide in a replenisher for a color developing solution exceeds $3\times10^{-3}$ mol/l.

When the amount of replenishment for a color developing solution is reduced, processing variation of color photographic light-sensitive material becomes large. In the case of replenishing amount of not more than 900 ml per $m^2$, concentration of a color developing solution due to evaporation and accumulation of the substances dissolved from photographic light-sensitive materials as described above cause trouble, and specifically result in increase in processing variation such as variation in gradation and increase in stain, etc.

Furthermore, it is a general practice to raise processing temperature in order to shorten a color developing time. In such a case, the above described processing variation and concentration due to evaporation become larger. In addition, other problems in that precipitates occur in the color developing solution and in that scum adheres onto the photographic light-sensitive materials accompany the use of a reduced amount of replenisher and the rapid processing. These problems become particularly severe when the color developing time is shortened.

SUMMARY OF THE INVENTION

Therefore, an object of the present invention is to provide a method for processing a silver halide color photographic material in which problems regarding the photographic characteristics do not occur when an amount of replenisher for a color developing solution is reduced.

Another object of the present invention is to provide a method for processing a silver halide color photographic material in which precipitates do not occur in a color developing solution and adhesion of scum onto the photographic material is prevented.

Other objects of the present invention will become apparent from the following detailed description and examples.

It has been found that these objects of the present invention can be accomplished by a method for processing a silver halide color photographic material comprising a support having thereon at least one silver halide emulsion layer and containing a magenta dye forming coupler represented by formula (I) shown below and a compound represented by formula (II) shown below in the same layer, wherein the silver halide color photographic material is subjected to color development using a replenisher for a color developing solution, whose concentration of bromide is not more than $3\times10^{-3}$ mol per liter and an amount of the replenisher for a color developing solution is not more than 900 ml per $m^2$ of the silver halide color photographic material.

Formula (I) is represented by

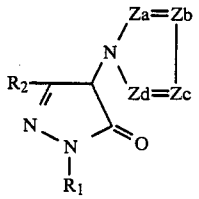

(I)

wherein $R_1$ represents an aromatic group, an aliphatic group or a heterocyclic group; $R_2$ represents a substituent; Za, Zb, Zc and Zd, which may be the same or different, each represents an unsubstituted methine group, a substituted methine group or —N=, Formula (II) is represented by $$(R'-COO^-)_n M^{n+} \quad \text{(II)}$$

wherein R' represents a substituent which imparts a diffusion-resistant property to the compound represented by formula (II); $M^{n+}$ represents a hydrogen ion, a metal ion, or an ammonium ion; and n represents an integer from 1 to 4.

DETAILED DESCRIPTION OF THE INVENTION

The magenta dye forming coupler (also referred to herein more as the "magenta coupler") represented by formula (I) which can be used in the present invention is described in more detail below.

In the above described formula (I), $R_1$ represents a straight chain or branched chain alkyl group having from 1 to 32 carbon atoms, and preferably from 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g., a cyclopentyl group, a cyclohexyl group, a norbornyl group, etc.), an aralkyl group (e.g., a benzyl group, a β-phenylethyl group, etc.), a cyclic alkenyl group (e.g., a cyclopentenyl group, a cyclohexenyl group, etc.), etc., which roups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_1$ may further represent an aryl group (e.g., a phenyl group, an α- or β-naphthyl group, etc.). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. A more preferable group for $R_1$ is a phenyl group which is substituted with an alkyl group, an alkoxy group, a halogen atom, etc., at at least one of the o-positions, because it is effective to restrain coloration of couplers remaining in film layers due to light or heat.

Furthermore, $R_1$ may represent a heterocyclic group (e.g., a 5-membered or 6-membered heterocyclic ring containing as a hetero atom at least one of a nitrogen atom, an oxygen atom and a sulfur atom, or a condensed ring thereof, with specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above described formula (I), $R_2$ represents a substituent such as a hydrogen atom, a straight chain or branched chain alkyl group having from 1 to 32 carbon atoms and preferably from 1 to 22 carbon atoms, an alkenyl group, a cyclic alkyl group, an aralkyl group or a cyclic alkenyl group (each of which may have one or more substituents as defined above as substituents for $R_1$), an aryl group or a heterocyclic group (which each also may have one or more substituents as defined above as substituents for $R_1$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a thioureido group (e.g., a thioureido group, an N-alkylthioureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., a n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), an acyloxy group (e.g., a benzoyloxy group, etc.), a sulfonyloxy group (e.g., a benzenesulfonyloxy group, etc.), a cyano group, a hydroxy group, a mercapto group, a halogen atom, a nitro group or a sulfo group.

Of the magenta dye forming couplers represented by formula (I), those wherein $R_2$ represents an anilino group, an acylamino group or an arylureido group and $R_1$ represents an aryl group which is substituted with a chlorine atom at at least one of the o-positions are particularly preferred.

When Za, Zb, Zc or Zd represents a substituted methine group in formula (I), the substituents may be selected from those as defined for $R_2$.

The nitrogen-containing ring compound of Za, Zb, Zc and Zd may further form another ring condensed therewith. For example, a 5-membered or 6-membered ring containing two adjacent groups selected from Za to Zd and preferably a hydrocarbon ring such as cyclohexene ring, a cyclopentene ring, a benzene ring, a naphthalene ring, etc., or a heterocyclic ring such as pyridine ring, a pyrimidine ring, a dihydrofuran ring, a dihydrothiophene ring, etc. can be used. These rings may be substituted with one or more substituents selected from those as defined for $R_2$. Za, Zb, Zc and Zd may be the same or different. However, a benzotriazolyl-1 group and a benzotriazolyl-2 group are excluded from the condensed ring described above.

Particularly preferred couplers among the couplers represented by formula (I) used in the present invention are those wherein (1) the group of the formula

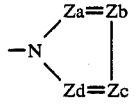

represents a 5-membered monocyclic nitrogen-containing aromatic heterocyclic group which is composed of Za, Zb, Zc and Zd that each represents a methine group, a substituted methine group or —N=, or (2) the group of the formula

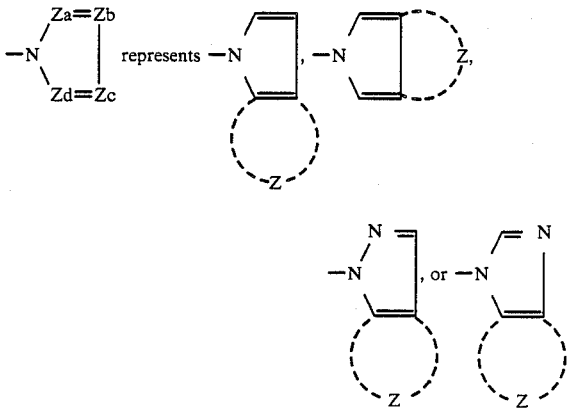

wherein Z represents a non-metallic atomic group forming a 5-membered or 6-membered ring. The substituted methine group has the same meaning as defined in the formula (I). The groups of

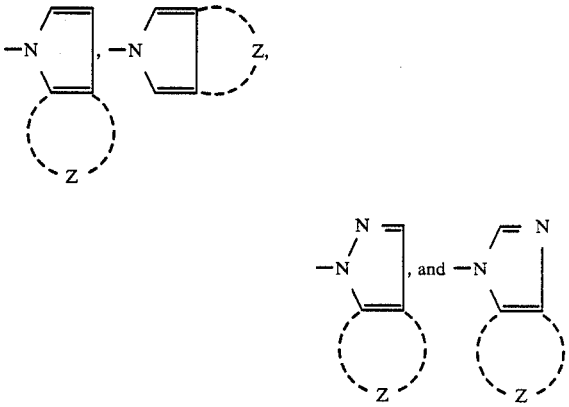

may be substituted with one or more substituents selected from those as defined for the substituted methine group. The 5-membered or 6-membered condensed ring portion represented by Z has the same meaning as defined in formula (I).

Specific examples of preferred nitrogen-containing heterocyclic groups represented by the formula

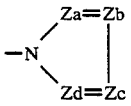

include a 1-imidazolyl group, a 2-methyl-1-imidazolyl group, a 2-methylthio-1-imidazolyl group, a 2-ethylthio-1-imidazolyl group, a 2,4-dimethyl-1-imidazolyl group, a 4-methyl-1 imidazolyl group, a 4-nitro-1-imidazolyl group, a 4-chloro1-imidazolyl group, a 4-phenyl-1-imidazolyl group, a 4-acetyl-1-imidazolyl group, a 4-tetradecanamido-1-imidazolyl group, a 1-pyrolyl group, a 3,4-dichloro-1-pyrolyl group, a 2-isoindolyl group, a 1-indolyl group, a 1-pyrazolyl group, a 1-benzimidazolyl group, a 5-bromo-1-benzimidazolyl group, a 5-octadecanamido-1-benzimidazolyl group, a 2-methyl-1benzimidazolyl group, a 5-methyl-1-benzimidazolyl group, a 7-purinyl group, a 2-indazolyl group, a 1,2,4,4-triazolyl group, a 1,2,3-1-triazolyl group, a 1-tetrazolyl group, etc. Among these, particularly preferred nitrogen-containing heterocyclic groups are a 1-imidazolyl group, a 2-methyl-1imidazolyl group, a 2,4-dimethyl-1-imidazolyl group, a 4-methyl-1-imidazolyl group, a 4-chloro-1-imidazolyl group, a 1-benzimidazolyl group, and a 1-tetrazolyl group.

The compound represented by formula (I) may be connected to a main chain of a polymer at a portion of $R_1$, $R_2$ or

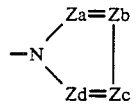

as described in Japanese Patent Application (OPI) Nos. 224352/83 and 35730/85, and U.S. Pat. No. 4,367,282.

Specific examples of preferred compounds represented by formula (I) are set forth below, but the present invention is not to be construed as being limited thereto.

(M-1)

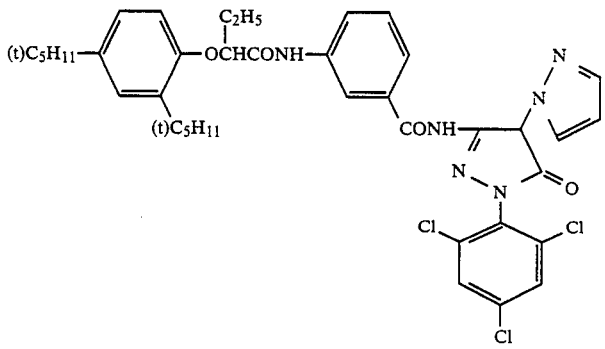

(M-2)

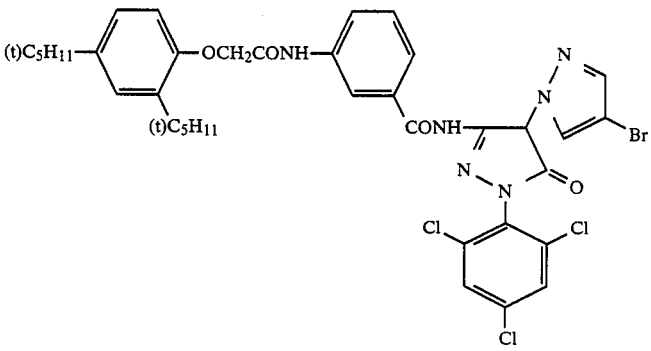

(M-3)

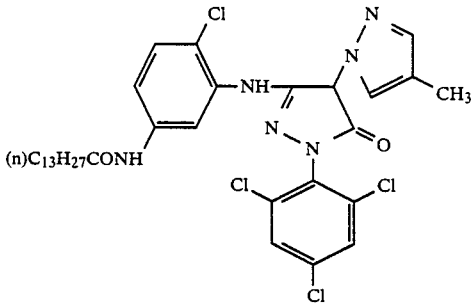

(M-4)

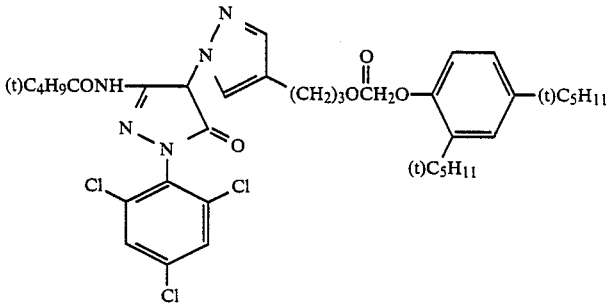

-continued
(M-5)
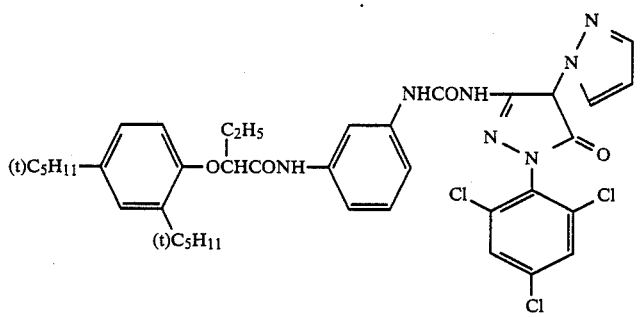
(M-6)
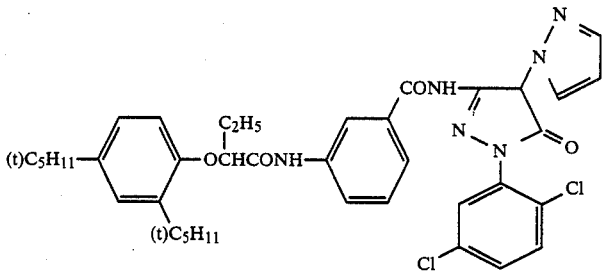
(M-7)
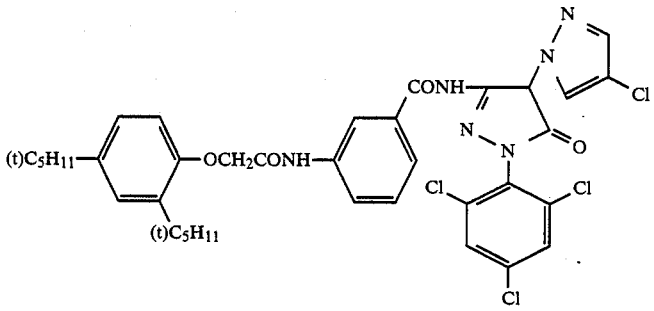
(M-8)
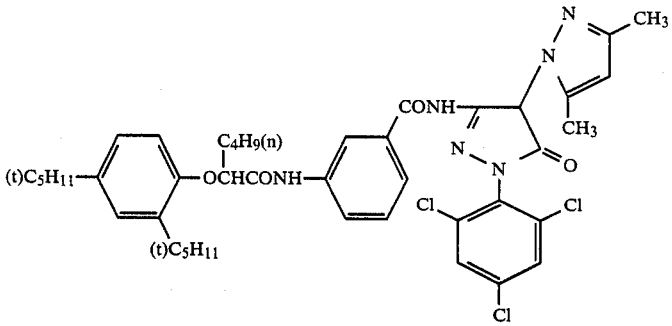
(M-9)
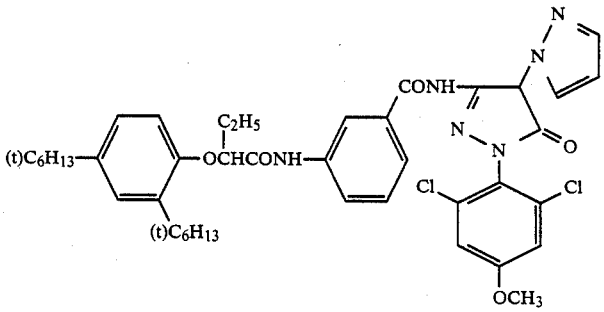

-continued
(M-10)
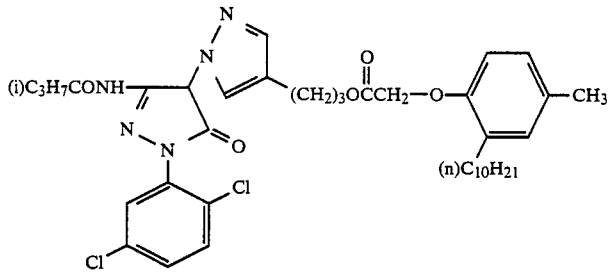
(M-11)
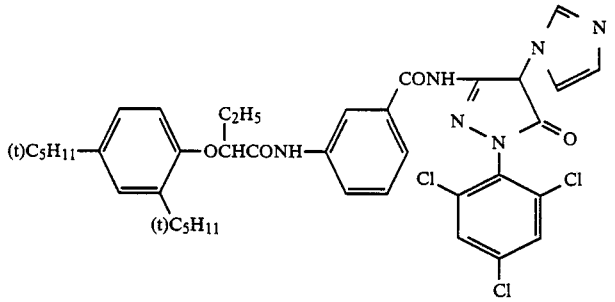
(M-12)
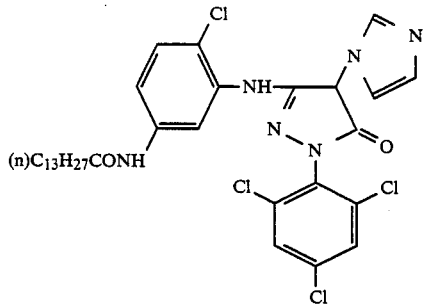
(M-13)
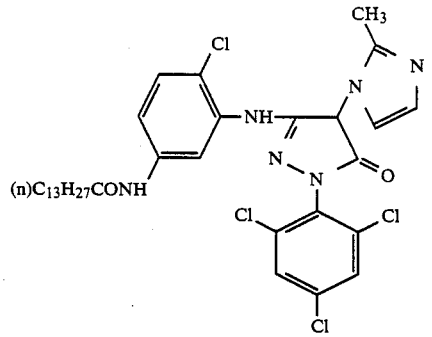
(M-14)
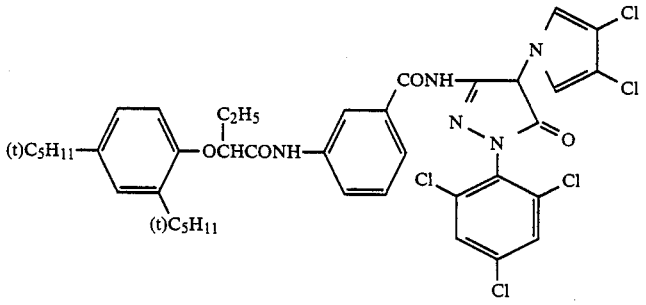

-continued
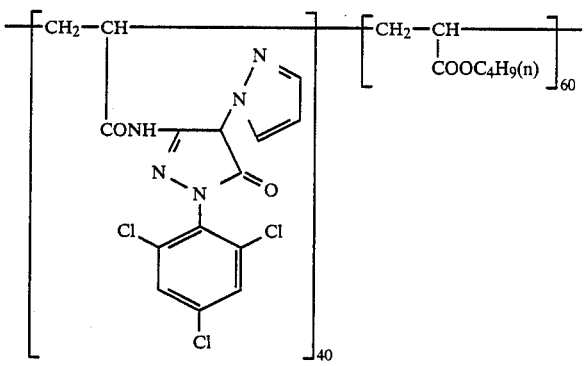
(M-15)
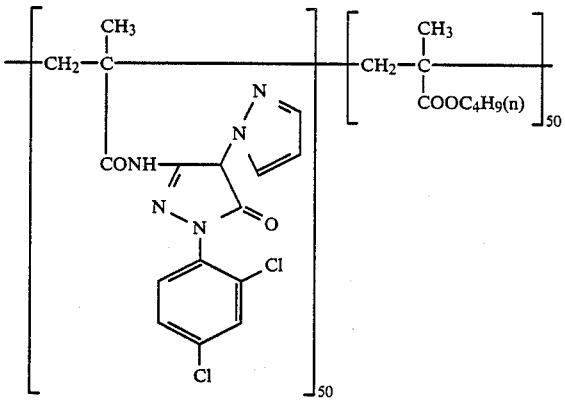
(M-16)
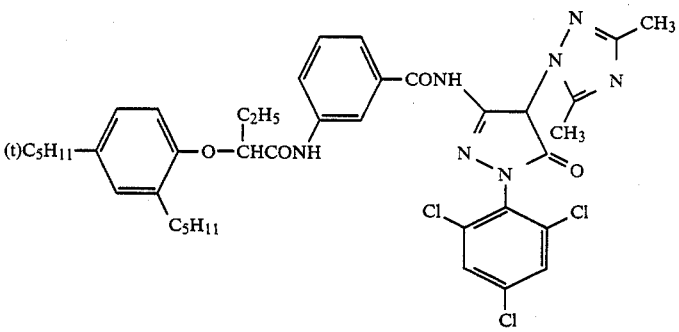
(M-17)
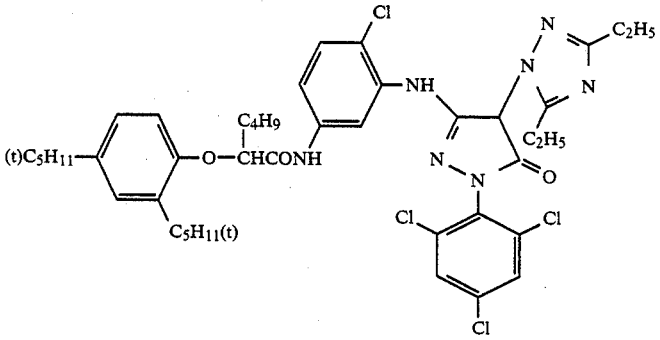
(M-18)

-continued
(M-19)
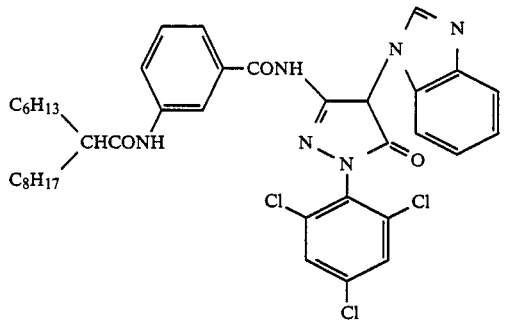
(M-20)
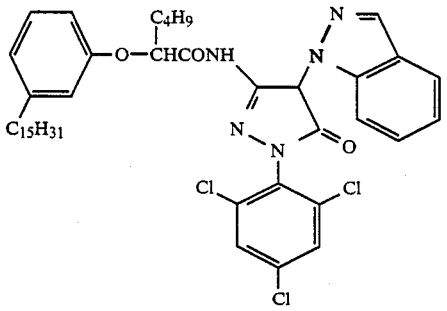
(M-21)
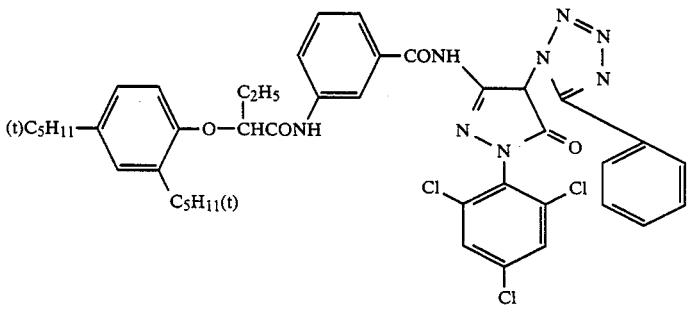
(M-22)
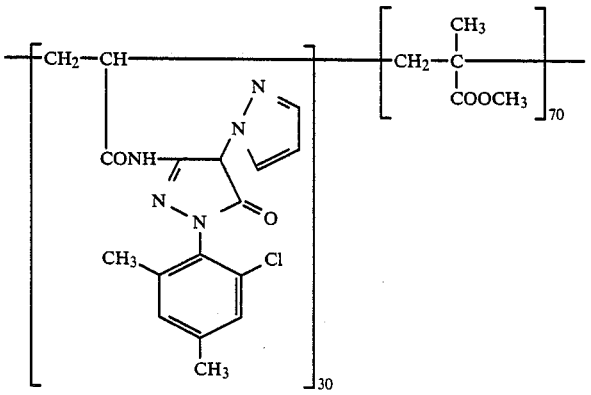

-continued
(M-23)
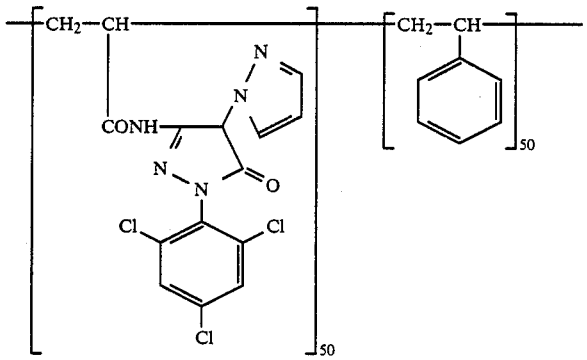
(M-24)
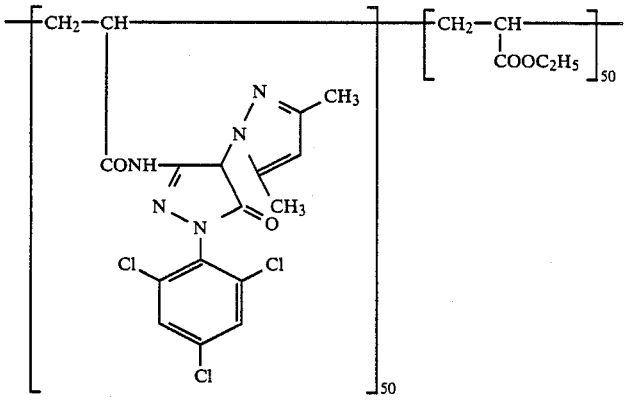
(M-25)
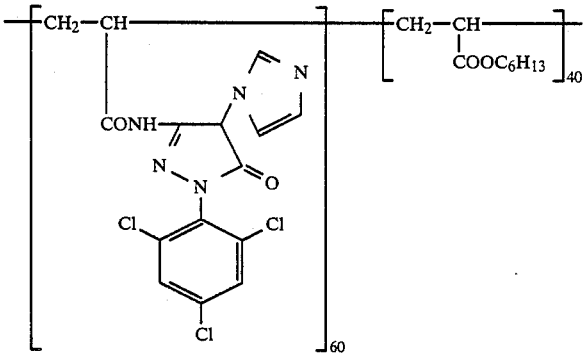
(M-26)
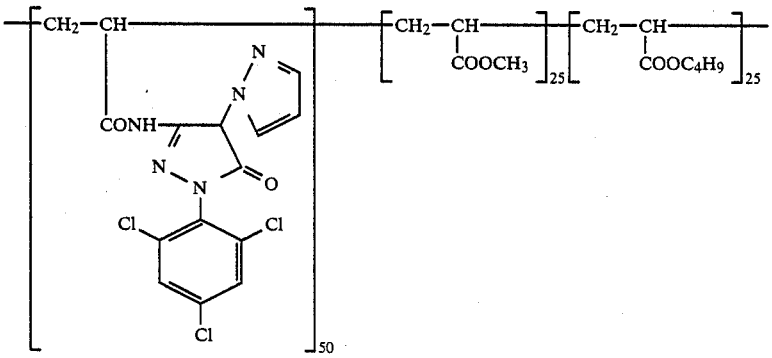

-continued
(M-27)
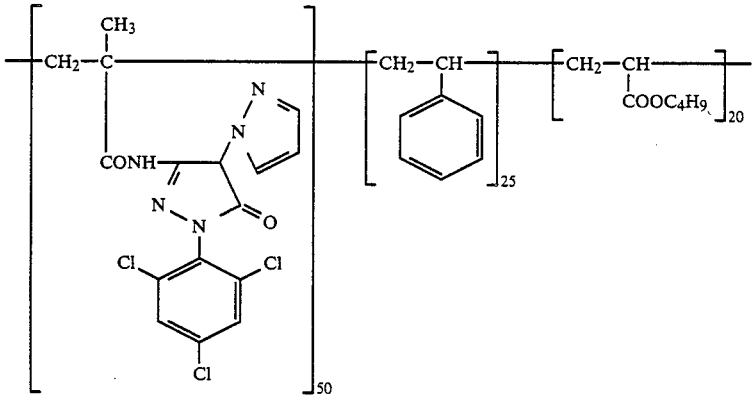
(M-28)
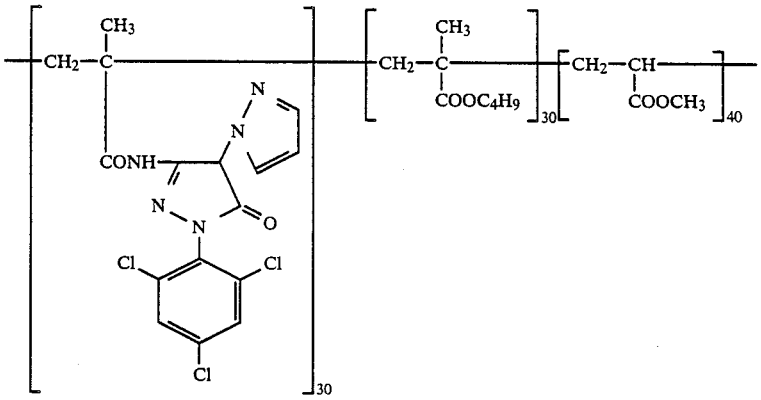
(M-29)
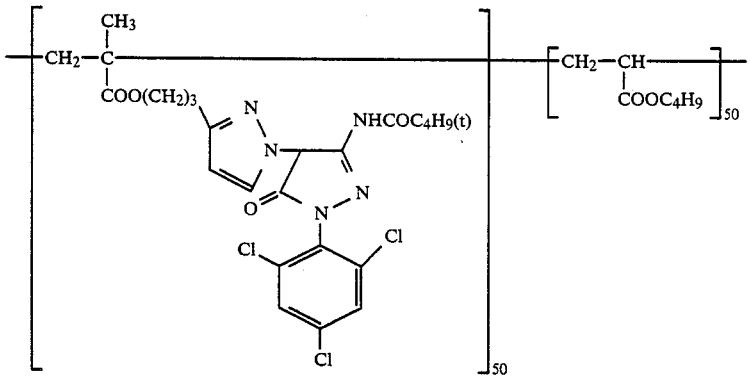
(M-30)
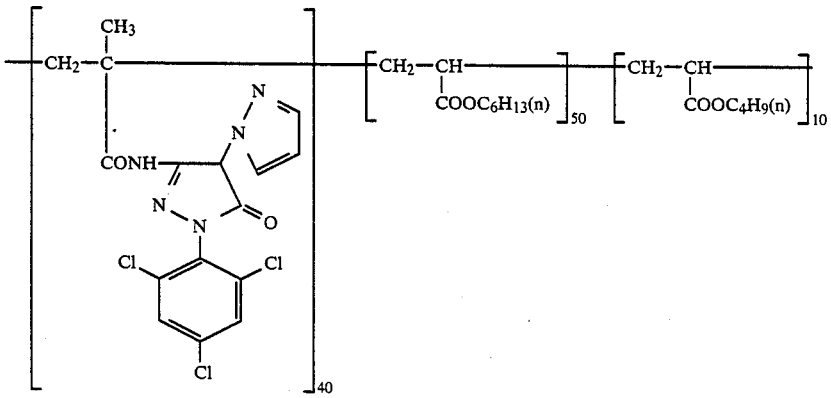

-continued
(M-31)
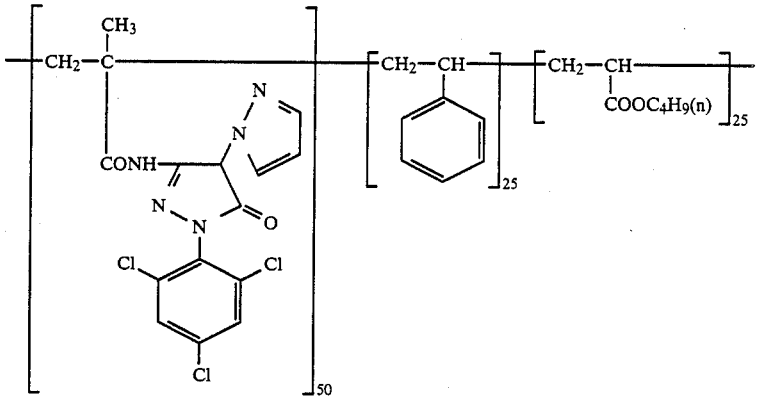
(M-32)
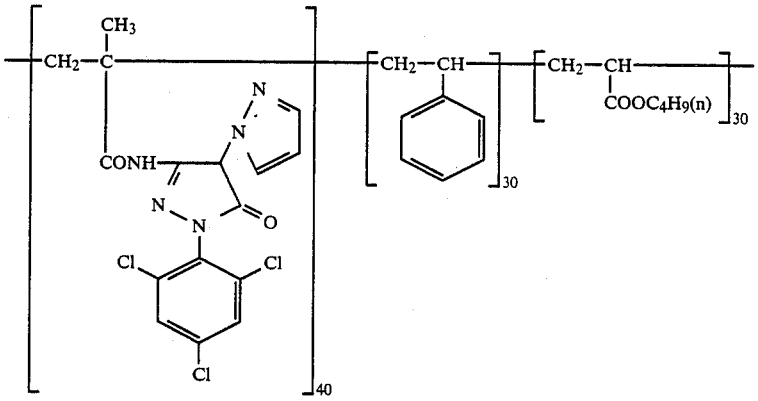
(M-33)
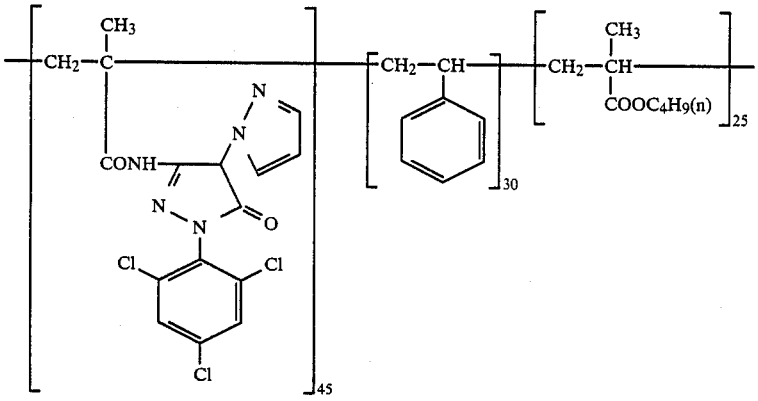
(M-34)
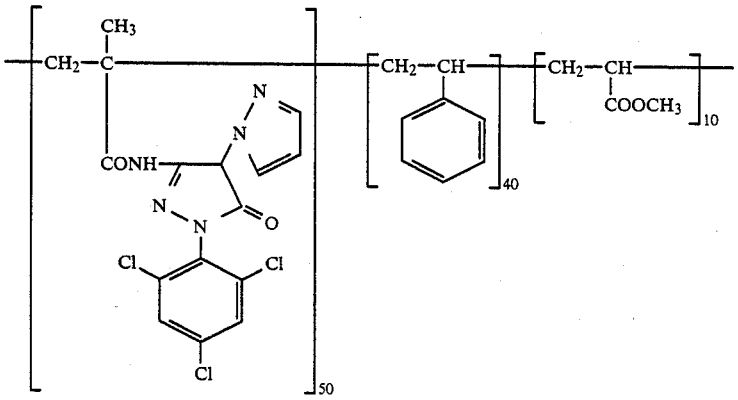

-continued (M-35)

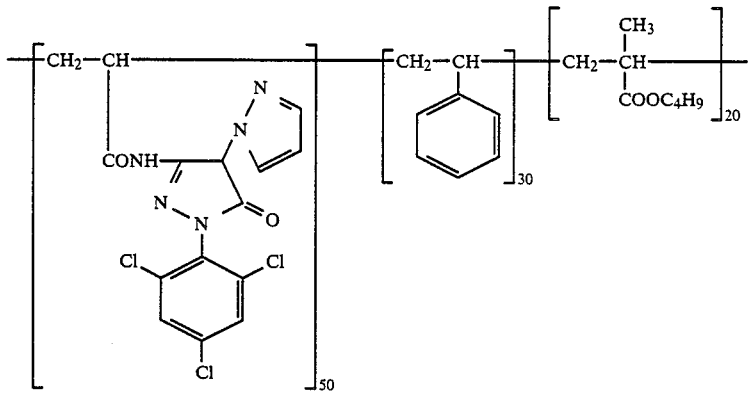

(M-36)

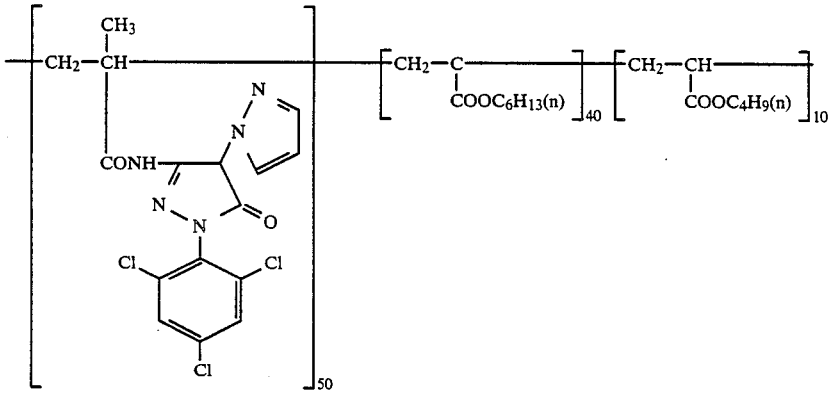

In the above formulae (M-15), (M-16) and (M-22) to (M-36), numerical values indicated mean a ratio of the component in a percent by weight.

The compounds represented by formula (I) can be synthesized according to the methods as described in Japanese patent application (OPI) No. 40825/81, U.S. Pat. Nos. 4,241,168, 4,310,619, 4,301,235, 4,308,343, 4,367,282, etc.

The compound represented by formula (II) which can be used in the present invention are described in more detail below.

In the above described formula (II), the group which imparts a diffusion-resistant property to the compound and is represented by R′ has from 8 to 40 carbon atoms and preferably from 12 to 32 carbon atoms, in total and represents a straight chain or branched chain alkyl group (e.g., a hexyl group, an octyl group, a dodecyl group, a pentadecyl group, etc.), an alkenyl group (e.g., an allyl group, etc.), a cyclic alkyl group (e.g., a cyclopentyl group, a cyclohexyl group, a norbornyl group, etc.), an aralkyl group (e.g., a benzyl group, a β-phenethyl group, etc.), a cyclic alkenyl group (e.g., a cyclopentenyl group, a cyclohexenyl group, etc.), etc., of which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acrylanilino group, a hydroxy group, a mercapto group, etc.

R′ may further represent an aryl group (e.g., a phenyl group, an α- or β-naphthyl group, etc.). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc.

Furthermore, R′ may represent a heterocyclic group (e.g., a 5-membered or 6-membered heterocyclic ring containing as a hetero atom at least one of a nitrogen atom, an oxygen atom and a sulfur atom, or a condensed ring thereof, with specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the formula (II), $M^{n+}$ can be selected from an ion of the group I in the Periodic Table (e.g., $H^+$, $Na^+$, $K^+$, $Cs^+$, etc.), an ion of the group II in the Periodic Table (e.g., $Mg^{2+}$, $Ca^{2+}$, $Ba^{2+}$, etc.), an ion of the group VIII in the Periodic Table (e.g., $Fe^{2+}$, $Fe^{3+}$, $Co^{2+}$, $Co^{3+}$, $Ni^{2+}$, etc.), and an ammonium ion which may be represented by the formula

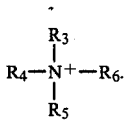

Of these cations, an cation of the group I, a cation of the group II and the ammonium ion are preferred. More preferred ions are $H^+$, $Na^+$, $K^+$ and $NH_4^+$, and $H^+$ is most preferred.

In the above described formula, $R_3$, $R_4$, $R_5$ and $R_6$, which may be the same or different, each represents a hydrogen atom, an alkyl group (e.g., a methyl group, an ethyl group, a tert-butyl group, etc.), a substituted alkyl group, an aralkyl group (e.g., a benzyl group, a phenethyl group, etc.), a substituted aralkyl group, an aryl group (e.g., a phenyl group, a naphthyl group, etc.) or a substituted aryl group, the total number of carbon atoms included in $R_3$, $R_4$, $R_5$ and $R_6$ being up to 20, or each two of $R_3$, $R_4$, $R_5$, and $R_6$ may be connected with each other to form a ring.

Suitable examples of the substituents for the alkyl group, the aralkyl group and the aryl group include a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methylsulfonamido group, etc.), a sulfamoyl group (e.g., a methylsulfamoyl group, etc.), a halogen atom (e.g., a fluorine atom, a chlorine atom, a bromine atom, etc.), a carboxy group, a carbamoyl group (e.g., a methylcarbamoyl group, etc.), an alkoxycarbonyl group (e.g., a methoxycarbonyl group, etc.), and a sulfonyl group (e.g., a methylsulfonyl group, etc.), etc. When two or more of these substituents are present, they may be the same or different.

Specific examples of preferred compounds represented by formula (II) are set forth below, but the present invention is not to be construed as being limited thereto.

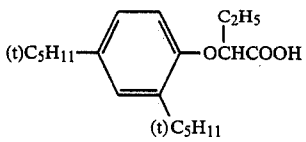
(A-1)

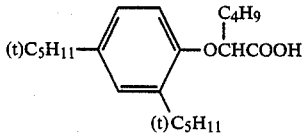
(A-2)

-continued

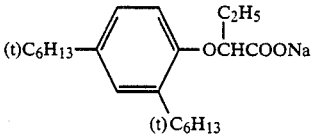
(A-3)

$C_{17}H_{35}COO^-NH_4^+$ (A-4)

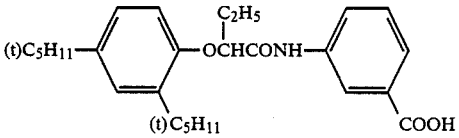
(A-5)

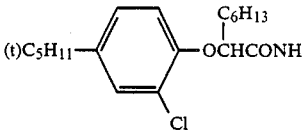
(A-6)

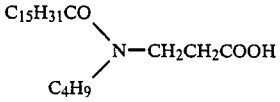
(A-7)

$C_{15}H_{31}COOH$ (A-8)

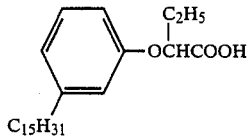
(A-9)

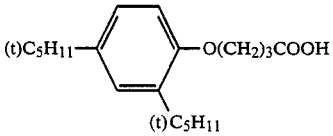
(A-10)

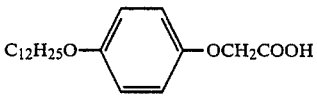
(A-11)

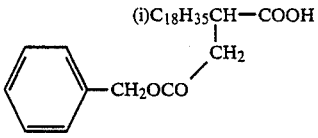
(A-12)

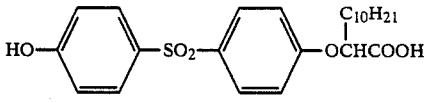
(A-13)

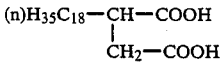
(A-14)

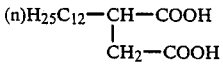
(A-15)

-continued (A-16)

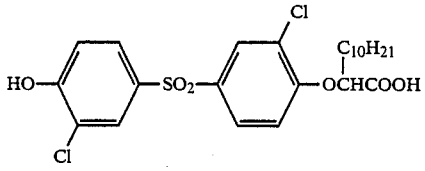

(A-17)

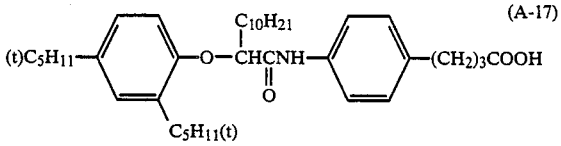

(A-18)

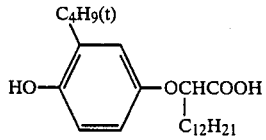

(A-19)

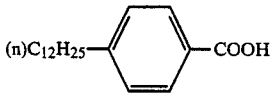

(A-20)

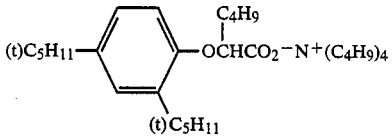

(A-21)

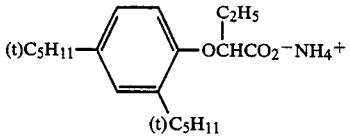

(A-22)

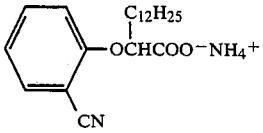

(A-23)

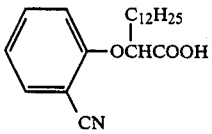

The magenta coupler represented by formula (I) used in the present invention can be added to a light-sensitive silver halide emulsion layer or a layer adjacent thereof of the silver halide color photographic material. It is preferred to add the magenta coupler to a light-sensitive silver halide emulsion layer.

The magenta coupler can preferably be added in a range from $5\times10^{-4}$ mol to 1 mol and particularly preferably from $3\times10^{-3}$ mol to 0.4 mol, per mol of silver halide present in the silver halide emulsion layer or an adjacent layer thereof.

The compound represented by formula (II) used in the present invention is added to a layer which contains the magenta coupler described above. The amount of the compound added is preferably in a range from 0.003 mol to 1 mol, more preferably from 0.01 mol to 0.5 mol and most preferably from 0.03 to 0.3 mol, per mol of the magenta coupler.

The improvement in image stability, particularly magenta image after processing by means of the combined use of the magenta dye forming coupler represented by formula (I) and the compound represented by formula (II) is described in Japanese Patent Application (OPI) No. 956/87. However, there are no teachings in the above application as to solving problems occurred in the case of reducing the amount of replenishment for a color developing solution.

The present invention is to obtain peculiar stable characteristics which are obtained by not only combining the photographic material of the present invention with a conventional replenisher of which the amount of replenisher is reduced, but also setting up a concentration of bromide in the range of $3\times10^{-3}$ mol/l or less which has not been used until now.

Therefore, a effect of the present invention is accomplished by the relation of the photographic material and the amount of the replenisher.

In the processing method of the present invention, the amount of replenisher for color development is not more than 900 ml/m$^2$, preferably from 50 ml/m$^2$ to 700 ml/m$^2$, and more preferably from 100 ml/m$^2$ to 500 ml/m$^2$.

The replenishment of a color developing solution can be performed according to a known method. It is preferred to employ a quantitative pump such as a bellows pump.

The concentration of bromide in the replenisher for a color developing solution according to the present invention is not more than $3\times10^{-3}$ mol per liter, and preferably not more than $2\times10^{-3}$ mol per liter. And it is particularly preferred that the replenisher does not contain bromide at all.

Specific examples of the bromide include an alkali metal bromide such as sodium bromide, potassium bromide, etc.

It is not desirable that the concentration of bromide in the replenisher exceeds $3\times10^{-3}$ mol per liter, since problems such as increase in variation of gradation and decrease in sensitivity, etc. occur.

The color photographic light-sensitive material according to the present invention can be subjected to development processing in a conventional manner as described, e.g., in *Research Disclosure,* RD No. 17643, pages 28 to 29 (Dec., 1978) and ibid., RD No. 18716, page 651, left column to right column (1979).

In order to carry out photographic processing of the light-sensitive material according to the present invention, any of known processes can be utilized. Also, known processing solution can be used. The processing temperature is usually selected from a range of from 18° C. to 50° C., but a temperature lower than 18° C. or a temperature higher than 50° C. may also be used.

A color developing solution which can be used in the present invention is generally composed of an alkaline aqueous solution containing a color developing agent. The useful color developing agent includes known primary aromatic amine developing agents such as a phenylenediamine (for example, 4-amino-N,N-diethylaniline-3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

Furthermore, color developing agents as described, for example, in L. F. A. Mason, *Photographic Processing Chemistry,* pages 226–229 (published by Focal Press, 1966), U.S. Pat. Nos. 2,193,015 and 2,592,364, and Japanese Patent Application (OPI) No. 64933/73, etc. may be used in the present invention.

The color developing solution used in the present invention can further contain pH buffers such as sulfites, carbonates, borates, and phosphates of alkali metals and development inhibitors and antifoggants such as bromides, iodides, and organic antifoggants. Also, if desired, the color developing solution may further contain hard water softing agents; preservatives such as hydroxylamine, etc.; organic solvents such as benzyl alcohol, diethylene glycol, etc.; development accelerators such as polyethylene glycol, quaternary ammonium salts, amines, etc.; dye-forming couplers; competing couplers; fogging agents such as sodium borohydride, etc.; auxiliary developing agents such as 1-phenyl-3-pyrazolidone, et al; viscosity imparting agents; polycarboxylic acid series chelating agents as described in U.S. Pat. No. 4,083,723; and antioxidants as described in West German Patent Application (OLS) No. 2,622,950, etc.

In particular, when a chelating agent represented by formula (III), (IV), or (V) shown below is added to the color developing solution, more preferred effects can be achieved in view of prevention of variation of gradation and increase in stain in a running process.

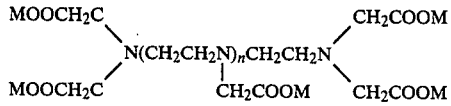
(III)

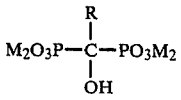
(IV)

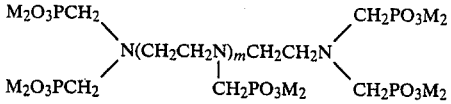
(V)

wherein n represents 1 or 2; m represents 0 or 1; R represents a lower alkyl group; and M (which may be the same or different) each represents a hydrogen atom or an alkali metal.

Specific examples of the chelating agents represented by formula (III), (IV) or (V) are set forth below, but the present invention is not to be construed as being limited thereto.

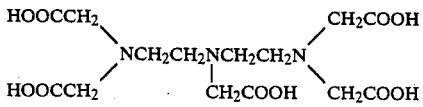
III-1

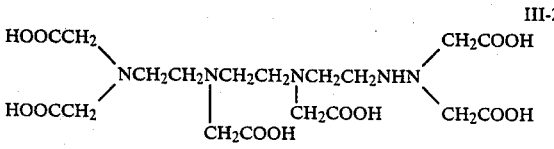
III-2

-continued

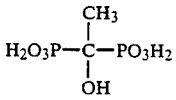
IV-1

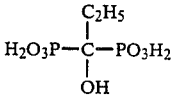
IV-2

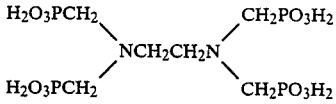
V-1

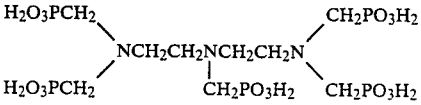
V-2

The chelating agent represented by formula (III), (IV) or (V) used in the present invention can be added to the color developing solution in a range of from $1\times10^{-4}$ mol to $2\times10^{-1}$ mol per liter, and preferably in a range of from $5\times10^{-4}$ mol to $5\times10^{-2}$ mol per liter. Further, two or more of these chelating agents may be employed together. A combination use of a compound represented by formula (III) and a compound represented by formula (IV) and a combination use of a compound represented by formula (III) and a compound represented by formula (V) are preferred. Particularly, a combination use of Compound III-1 and Compound IV-1 described above is preferred. Moreover, these chelating agents may be employed together with other conventional chelating agents.

The pH of the color developing solution is ordinarily 7 or higher, and most generally from 10 to 13. The processing temperature of the color developing solution according to the present invention is preferably from 20° C. to 50° C. and more preferably from 35° C. to 45° C. The processing time of color development is generally from 20 seconds to 10 minutes, preferably from 30 seconds to 4 minutes, and more preferably from 40 seconds to 3 minutes.

The photographic light-sensitive materials are usually bleached after color development. The bleaching process may be performed simultaneously with a fixing process or separately from the fixing process.

Bleaching Solution, Bleach-Fixing Solution, Fixing Solution

A bleaching agent used in a bleaching solution or a bleach-fixing solution employed in the present invention is preferably a ferric ion complex. The ferric ion complex is a complex of a ferric ion and a chelating agent such as an aminopolycarboxylic acid and an aminopolyphosphonic acid or a salt thereof. Salts of aminopolycarboxylic acids or aminopolyphosphonic acids are salts of an aminopolycarboxylic acid or aminopolyphosphonic acid with an alkali metal, an ammonium, or a water-soluble amine. Examples of the alkali metal include sodium, potassium, and lithium. Examples of the water-soluble amine include an alkylamine such as methylamine, diethylamine, triethylamine, and butylamine; an alicyclic amine such as cyclohexylamine; an arylamine such as aniline and m-toluidine; and a heterocyclic amine such as pyridine, morpholine, and piperidine.

Typical examples of the chelating agents such as aminopolycarboxylic acids, aminopolyphosphonic acids, or salts thereof are set forth below, but the present invention is not to be construed as being limited thereto.

Ethylenediaminetetraacetic acid
Disodium ethylenediaminetetraacetate
Diammonium ethylenediaminetetraacetate
Tetra(trimethylammonium)ethylenediaminetetraacetate
Tetrapotassium ethylenediaminetetraacetate
Tetrasodium ethylenediaminetetraacetate
Trisodium ethylenediaminetetraacetate
Diethylenetriaminepentaacetic acid
Pentasodium diethylenetriaminepentaacetate
Ethylenediamine-N-(β-oxyethyl)-N,N',N'-triacetic acid
Trisodium ethylenediamine-N-(β-oxyethyl)-N,N',N'-triacetate
Triammonium ethylenediamine-N-(β-oxyethyl)-N,N',N'-triacetate
1,2-Diaminopropanetetraacetic acid
Disodium 1,2-diaminopropanetetraacetate
1,3-Diaminopropanetetraacetic acid
Diammonium 1,3-diaminopropanetetraacetate
Nitrilotriacetic acid
Trisodium nitrilotriacetate
Cyclohexanediaminetetraacetic acid
Disodium cyclohexanediaminetetraacetate
Iminodiacetic acid
Dihydroxyethylglycine
Ethyl ether diaminetetraacetic acid
Glycol ether diaminetetraacetic acid
Ethylenediaminetetrapropionic acid
Phenylenediaminetetraacetic acid
1,3-Diaminopropanol-N,N,N',N'-tetramethylenephosphonic acid
Ethylenediamine-N,N,N',N'-tetramethyllenephosphonic acid
1,3-Propylenediamine-N,N,N',N'-tetramethylenephosphonic acid The ferric ion complex salts may be used in the form of a complex salt per se or may be formed in situ in solution by using a ferric salt (e.g., ferric sulfate, ferric chloride, ferric nitrate, ferric ammonium sulfate, or ferric phosphate) and a chelating agent (e.g., an aminopolycarboxylic acid, aminopolyphosphonic acid, or phosphonocarboxylic acid). When they are used in the form of a complex salt, they may be used alone or as a combination of two or more. On the other hand, where a complex is formed in situ in solution by using a ferric salt and a chelating agent, one or two or more ferric salts may be used. Further, one or two or more chelating agents may also be used. In every case, a chelating agent may be used in an amount in excess of that necessary for forming a ferric ion complex salt.

Of the ferric ion complexes, ferric complexes of aminopolycarboxylic acids are preferred.

In the bleaching solution or the bleach-fixing solution, a bleach accelerating agent can be used, if desired. Specific examples of suitable bleach accelerating agents include compounds having a mercapto group or a disulfide group which are preferred in view of their large bleach accelerating effects. Particularly, the compounds as described in U.S. Pat. No. 3,893,868, West German Patent No. 1,290,812, and Japanese Patent Application (OPI) No. 95630/78 are preferred.

The bleaching solution or bleach-fixing solution used in the present invention can further contain rehalogenating agents such as bromides (e.g., potassium bromide, sodium bromide, and ammonium bromide), chlorides (e.g., potassium chloride, sodium chloride, and ammonium chloride), or iodides (e.g., ammonium iodide). Further, one or more kinds of inorganic acids, organic acids, alkali metal salts or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, and tartaric acid), or corrosion preventing agents (e.g., ammonium nitrate and guanidine) may be added, if desired.

As fixing agents which can be employed in the bleach-fixing solution or fixing solution used in the present invention, known fixing agents, that is, water-soluble silver halide solvents such as thiosulfates (e.g., sodium thiosulfate and ammonium thiosulfate); thiocyanates (e.g., sodium thiocyanate and ammonium thiocyanate); thioether compounds (e.g., ethylenebisthioglycolic acid and 3,6-dithia-1,8-octanediol); and thioureas may be used individually or as a combination of two or more thereof. In addition, a special bleach-fixing solution comprising a combination of a fixing agent and a large amount of a halide compound such as potassium iodide as described in Japanese Patent Application (OPI) No. 155354/76 can be used as well. In the present invention, a thiosulfate, particularly ammonium thiosulfate, is preferably employed.

The amount of the fixing agent used in the bleachfixing solution or fixing solution is preferably in a range from 0.3 mol to 2 mol per liter of the solution. In the case of color photographic light-sensitive materials for photographing, a range from 0.8 mol to 1.5 mol per liter of the solution is particularly preferred. On the other hand, in the case of color photographic light-sensitive materials for printing, a range from 0.5 mol to 1 mol per liter of the solution is particularly preferred.

The pH of the bleach-fixing solution or fixing solution used in the present invention is preferably from 5 to 9. When the pH of the bleach-fixing solution or fixing solution is lower than this value, the desilvering property is improved, but there is a tendency that degradation of the solution and the formation of leuco dyes from cyan dyes are accelerated. On the contrary, when the pH is higher than this value, delayed desilvering, and increase in stain are apt to occur.

In order to adjust the pH, the bleach-fixing solution or fixing solution may contain, if desired, hydrochloric acid, sulfuric acid, nitric acid, acetic acid, a bicarbonate, ammonia, potassium hydroxide, sodium hydroxide, sodium carbonate, or potassium carbonate. Further, various kinds of fluorescent brightening agents, defoaming agents, surface active agents, polyvinyl pyrrolidone, and organic solvents (e.g., methanol) may be incorporated into the bleach-fixing solution or fixing solution.

The bleach-fixing solution or fixing solution used in the present invention can contain, as preservatives, compounds capable of releasing sulfite ions such as sulfites (e.g., sodium sulfite, potassium sulfite, and ammonium sulfite), bisulfites (e.g., ammonium bisulfite, sodium bisulfite, and potassium bisulfite), and metabisulfites (e.g., potassium metabisulfite, sodium metabisulfite, and ammonium metabisulfite). The amount of such a compound added is preferably from about 0.02 mol to about 0.50 mol, and more preferably from about 0.04 mol to about 0.40 mol, per liter of the solution, calculated in terms of sulfite ion.

While it is common to add sulfites as preservatives, other compounds, such as ascorbic acid, a carbonylbisulfic acid adduct, and a carbonyl compound, may be added.

Further, buffers, fluorescent brightening agents, chelating agents, and antimold agents may be added, if desired.

After the fixing step or the bleach-fixing step, it is typical to conduct a processing step including water washing and stabilizing. It is also possible to employ a simplified processing method, that is, to carry out only a water washing step or to carry out only a stabilizing step without conducting a substantial water washing step.

The water washing bath in the present invention is a bath having a main purpose of washing out the components of the processing solutions adhered to or contained in color photographic light-sensitive materials and the components of the color photographic light-sensitive materials which should be removed therefrom in order to maintain photographic properties and stability of images formed after processing.

Also, the stabilizing bath is a bath having imparted thereto an image stabilizing function which can not be obtained by the water washing bath in addition to the function of the water washing bath described above. For example, a bath containing formalin, etc., is an example.

The terminology "amount carried over from the preceding bath" means an amount from the preceding bath, which is adhered to or contained in the color photographic light-sensitive material and introduced into the water washing bath. The amount can be determined by immersing the color photographic light-sensitive material collected just before the introduction thereof to the water washing bath in water, extracting the components in the preceding bath and measuring the amount of the components of the preceding bath.

In the present invention, the amount of replenishment to the water washing bath or the stabilizing bath substituted therefor is in a range from 2 to 50 times, preferably from 3 to 50 times, and more preferably from 5 to 30 times, as large as amount carried over from the preceding bath by the light-sensitive material, per a unit area of the color photographic light-sensitive material.

The pH of the water washing bath or the stabilizing bath is generally from 4 to 10, preferably from 5 to 9, and more preferably from 6.5 to 8.5

It is preferred to employ water which is subjected to water softening treatment as washing water or a stabilizing solution. The water softening treatment can be carried out by a method using an ion exchange resin or a reverse permeation device.

As an ion exchange resin, a sodium type strong acidic cationic exchange resin in which a counter ion of an exchange group is a sodium ion is preferred. Also, an H type strong acidic cationic exchange resin, and an ammonium type strong acidic cationic exchange resin may be employed. Further, it is preferred to use an H type strong acidic cationic exchange resin together with an OH type strong basic anionic exchange resin. As a resin substratum, a copolymer of styrene, divinylbenzene, etc., is preferred. Particularly, a copolymer in which an amount of divinylbenzene is from 4 to 16% by weight based on the total weight amount of monomers used in the preparation thereof is preferred. Suitable examples of ion exchange resins include Diaion SK-1B, Diaion PK-216 (trademark for product manufactured by Mitsubishi Chemical Industries Ltd.), etc.

Various reverse permeation devices can be employed. A device using a cellulose acetate or polyethersulfone film is suitably used. A device having pressure of 20 kg/cm$^2$ or less is preferably used because of its low noise.

Using water in which the amount of calcium or magnesium is reduced using an ion exchange resin or a reverse permeation device, the propagation of bacteria or molds is controlled, and thus further preferred results can be obtained by the use of such water in the method of the present invention.

According to a preferred embodiment, at least one selected from an aminocarboxylic acid, an aminophosphonic acid, a phosphonic acid, a phosphonocarboxylic acid and a salt thereof is added to the washing water or the stabilizing solution is an amount of from $5\times10^{-4}$ to $1\times10^{-2}$ mol per liter of the water or solution.

Specific examples of these aminocarboxylic acids, aminophosphonic acids, phosphonic acids and phosphonocarboxylic acids are set forth below.

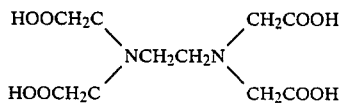
(B-1)

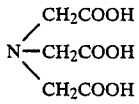
B-2

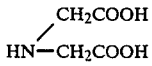
B-3

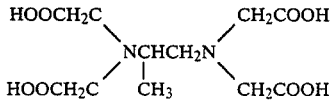
B-4

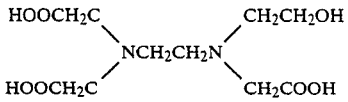
B-5

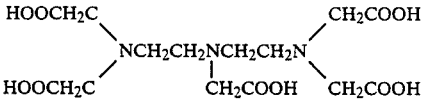
B-6

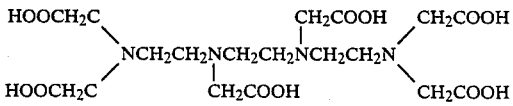
B-7

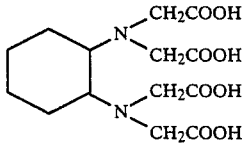
B-8

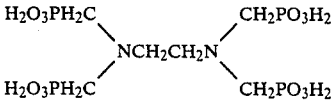
B-9

-continued

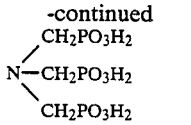

B-10

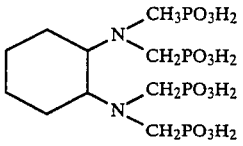

B-11

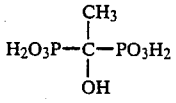

B-12

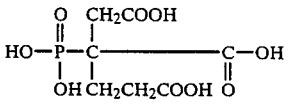

B-13

Useful salts for aminocarboxylic acids, aminophosphonic acids, phosphonic acids or phosphonocarboxylic acids in the present invention include a sodium salt, a potassium salt, a calcium salt, an ammonium salt, a magnesium salt, etc. Ordinarily, an ammonium salt, a sodium salt and a potassium salt are preferably employed, but a preferred compound may be varied depending on the solution.

The amount of aminocarboxylic acid, aminophosphonic acid, phosphonic acid, phosphonocarboxylic acid or salt thereof to be incorporated into at least the final tank of the tanks constituting the water washing bath is from $5\times10^{-5}$ to $1\times10^{-2}$ mol and preferably from $1\times10^{-4}$ to $5\times10^{31\ 3}$ mol, per liter of the water or solution. When the amount used is smaller than $5\times10^{-5}$ mol per liter, the effect of the compound can not be attained and on the other hand, the use of an amount exceeding $1\times10^{-2}$ mol per liter may lead to undesirable results in that deposits occur on the surface of the color photographic material after drying and in that stickiness and adhesion of scum occur.

Further, it is preferred to add an isothiazoline type antibiotic to the washing water or the stabilizing solution. Specific examples of useful antibiotics are set forth below.

(1) 2-Methyl-4-isothiazolin-3-one
(2) 5-Chloro-2-methyl-4-isothiazolin-3-one
(3) 2-Methyl-5-phenyl-4-isothiazolin-3-one
(4) 4-Bromo 5-chloro-2-methyl-4-isothiazolin-3-one
(5) 2-Hydroxymethyl-4-isothiazolin-3-one
(6) 2-(2-Ethoxyethyl)-4-isothiazolin-3-one
(7) 2-(N-Methylcarbamoyl)-4-isothiazolin-3-one
(8) 5-Bromomethyl-2-(N-dichlorophenylcarbamoyl)-4-isothiazolin-3-one
(9) 5-Chloro-2-(2-phenylethyl)-4-isothiazolin-3-one
(10) 4-Methyl-2-(3,4-dichlorophenyl)-4-isothiazolin-3-one The antibiotic is employed in a range from 1 to 100 mg per liter, preferably from 3 to 30 mg per liter of the washing water or the stabilizing solution.

The above described water softening method using an ion exchange resin or a reverse permeation device, chelating agent such as an aminopolycarboxylic acid and antibiotic such as an isothiazolin can be employed in combination in order to effectively achieve their objects.

Moreover, irradiation of ultraviolet ray to at least one of the replenishing tanks and processing tanks for water washing or stabilizing is also a preferred embodiment for the purpose of controlling the propagation of bacteria or molds. In order to carry out such ultraviolet irradiation. a method in which ultraviolet radiation is provided from outside of the tank(s), a method in which ultraviolet radiation is provided in the water or solution by setting a water proof type ultraviolet lamp in the replenishing tank or processing tank or its circulation system.

Various kinds of compounds may be added to the water washing bath or the stabilizing bath according to the present invention in addition to the above described materials. Representative examples of such compounds include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., which can be used in combinations, also) in order to adjust pH of layers. Further, various additives such as a surface active agent, a fluorescent brightening agent, a hardening agent, a metal salt, etc., may be employed. Two or more compounds for the same purpose or different purposes may be employed together.

Furthermore, it is possible to add various ammonia salts such as ammonium chloride, ammonium nitrate, ammonium sulfate, ammonium phosphate, ammonium sulfite, ammonium thiosulfate, etc., as pH adjusting agents for layers after development processing.

In the case wherein the preceding bath is a bath having a fixing function, a fixing agent component, for example, a thiosulfate is carried over into the water washing or stabilizing bath, and, as the result, a sulfidation phenomenon may occur. In order to prevent the sulfidation, a sulfite such as sodium sulfite, potassium sulfite, ammonium sulfite, etc. can be added to the water or solution.

Further, it is a preferred embodiment to employ a sulfanylamide, a benzotriazole, a phenylphenolic acid, etc., for the purpose of preventing the propagation of bacteria in the water washing or stabilizing bath.

The processing time for the water washing or stabilizing bath can be varied depending on purposes and kinds of color photographic light-sensitive materials, but is usually from 10 seconds to 10 minutes, and preferably from 20 seconds to 5 minutes. The temperature of the water washing or stabilizing bath is usually from 20° C. to 45° C., preferably from 25° C. to 40° C. and particularly preferably from 30° C. to 40° C.

It is preferred in the present invention that the water washing or stabilizing bath is composed of a multistage countercurrent process using two or more tanks, preferably from two to four tanks in view of saving the amount of replenishment required.

To the stabilizing bath, a component capable of imparting an image stabilizing effect which can not be obtained by the water washing step is further added. For example, an aldehyde compound such as formalin, etc., can be employed for this purpose.

The water washing step may be a conventional system using a comparatively large amount of water or a water-saving system in which the amount of water used is reduced.

The present invention can be applied to various color photographic light-sensitive materials. Typical examples of color photographic light-sensitive materials to be employed include color negative films for general use or cinematography, color reversal films for slide or television, color paper, color positive films, color direct positive paper, and color reversal paper, etc. In particular, the present invention is preferably applied to color negative films for photographing.

The photographic emulsions used in the present invention can be prepared according to known methods.

As the silver halide color photographic materials used in the present invention, color negative films for photographing are particularly preferably employed. The coating amount of silver in the photographic light-sensitive material is generally from 1 $g/m^2$ to 10 $g/m^2$, and preferably from 3 $g/m^2$ to 7 $g/m^2$ in terms of the silver content.

Surface latent image type silver halides are ordinarily employed in photographic emulsion layers of the photographic light-sensitive material used in the present invention.

In the photographic emulsion layers of the color photographic light-sensitive material used in the present invention, any of silver bromide, silver iodobromide, silver iodochlorobromide, silver chlorobromide and silver chloride may be used as the silver halide. A preferred silver halide is silver iodobromide or silver iodochlorobromide each containing 30 mol % or less of silver iodide. Silver iodobromide containing 2 mol % or more, and particularly from 2 mol % to 25 mol % of silver iodide, is preferred.

Silver halides containing 2 mol % or more of silver iodide are also preferred in view of further preventing the formation of sludge in the processing solution.

Silver halide grains in the photographic emulsion may have a regular crystal structure, for example, a cubic, octahedral or tetradecahedral structure, etc., an irregular crystal structure, for example, a spherical structure, etc., a crystal defect, for example, a twinned plane, etc., or a composite structure thereof.

Further, tabular grains having an aspect ratio of 5 to 20 are preferably employed. The tabular silver halide grains may have uniform halogen composition or may be composed of two or more phases having different halogen compositions. For example, in the case of silver iodobromide, tabular silver iodobromide grains having a stratiform structure composed of plural phases having an iodide content different from each other can be used.

Preferred examples of the halogen composition and halogen distribution in grains of the tabular silver halide grains are described in Japanese patent application (OPI) Nos. 113928/83 and 99433/84, etc.

A grain size of silver halide may be varied and include from fine grains having 0.1 micron or less to large size grains having 10 microns, of a diameter of projected area. Further, a monodisperse emulsion having a narrow grain size distribution and/or a polydisperse emulsion having a broad grain size distribution may be used.

The silver halide emulsion is usually chemically sensitized. The chemical sensitization can be carried out using active gelatin as described in T. H. James, *The Theory of the Photographic Process,* 4th ed., pages 67 to 76 (The Macmillan Co., 1977). Further, the chemical sensitization can be conducted using a sensitizer such as sulfur, selenium, tellurium, gold, platinum, palladium, iridium or a combination of two or more thereof at a pAg of 5 to 10, a pH of 5 to 8 and temperature of 30° to 80° C. as described in *Research Disclosure,* Vol. 120, RD No. 12008 (April, 1974), ibid., Vol. 134, No. 13452 (June, 1975), U.S. Pat. Nos. 2,642,361, 3,297,446, 3,772,031, 3,857,711, 3,901,714, 4,266,018 and 3,904,415, British Patent No. 1,315,755, etc. Suitable chemical sensitization is conducted in the presence of a gold compound and a thiocyanate compound or in the presence of a sulfur containing compound as described in U.S. Pat. Nos. 3,857,711, 4,266,018 and 4,054,457 or a sulfur containing compound such as hypo (sodium thiosulfate), a thiourea type compound, a rhodanine type compound, etc.

The chemical sensitization may be carried out in the presence of a chemical sensitizing assistant. Examples of the chemical sensitizing assistants to be employed include compounds which are known as compounds for preventing fog during the chemical sensitization step and increasing sensitivity, such as azaindene, azapyridazine, azapyrimidine, etc. Examples of chemical sensitizing assistant modifiers are described in U.S. Pat. Nos. 2,131,038, 3,411,914 and 3,554,757, Japanese patent application (OPI) No. 126526/83, G. F. Duffin, *Photographic Emulsion Chemistry,* pages 138 to 143 (The Focal Press, 1966), etc.

In addition to or in place of the chemical sensitization, reduction sensitization using hydrogen as described in U.S. Pat. Nos. 3,891,446, 3,984,249, etc., reduction sensitization using a reducing agent such as stannous chloride, thiourea dioxide, a polyamine, etc. as described in U.S. Pat. Nos. 2,518,698, 2,743,182, 2,743,183, etc., or reduction sensitization using treatment at low pAg (for example, pAg of less than 5) and/or high pH (for example, pH of more than 8) can be conducted.

Moreover, spectral sensitivity can be improved using the chemical sensitization as described in U.S. Pat. Nos. 3,917,485 and 3,966,476, etc.

The silver halide photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

These sensitizing dyes can be employed individually, an can also be employed in combination. A combination of sensitizing dyes is often used particularly for the purpose of supersensitization.

The sensitizing dyes may be present in the emulsion together with dyes which themselves do not give rise to spectrally sensitizing effects, but exhibit a supersensitizing effect of materials which do not substantially absorb visible light but exhibit a supersensitizing effect. For example, aminostilbene compounds substituted with a nitrogen-containing heterocyclic group (e.g., those as described in U.S. Pat. Nos. 2,933,390 and 3,635,721), aromatic organic acid-formaldehyde condensates (e.g., those as described in U.S. Pat. No. 3,743,510), cadmium salts, azaindene compounds, and the like, can be present. The combinations as described in U.S. Pat. Nos. 3,615,613, 3,615,641, 3,617,295, 3,635,721, etc. are particularly useful.

The potographic silver halide emulsion used in the present invention may include various compounds for the purpose of preventing fog formation or of stabilizing photographic performance in the photographic light-sensitive material during the production, storage or photographic processing thereof. For example, those compounds shown as antifoggants or stabilizers can be incorporated, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxy-substituted (1,3,3a,7)tetrazaindenes), pentaazaindenes, etc.; benzenethiosulfonic acids; benzenesulfinic acids; ammonium benzenesulfonic acids; etc.

The photographic emulsions used in the present invention are usually conducted with physical ripening, chemical ripening and spectral sensitization. Various kinds of additives which can be employed in these steps are described in *Research Disclosure,* Vol. 176, RD No. 17643 (December, 1978) and ibid., Vol. 187, RD No. 18716 (November, 1979), and described items therein are summarized in the table shown below.

Further, known photographic additives which can be used in the present invention are also described in the above-noted *Research Disclosure* publications, and disclosed items thereof are summarized in the table below.

| No. | Kind of Additives | RD 17643 | RD 18716 |
|---|---|---|---|
| 1. | Chemical Sensitizer | Page 23 | Page 648, right column |
| 2. | Sensitivity Increasing Agents | — | " |
| 3. | Spectral Sensitizers | Pages 23 to 24 | Page 648, right column to page 649, right column |
| 4. | Super Sensitizers | " | Page 648, right column to page 649, right column |
| 5. | Brightening Agents | Page 24 | — |
| 6. | Antifoggants and Stabilizers | Pages 24 to 25 | Page 649, right column |
| 7. | Couplers | Page 25 | Page 649, right column |
| 8. | Organic Solvents | Page 25 | — |
| 9. | Light-Absorbers, Filter Dyes | Pages 25 to 26 | Page 649, right column to page 650, left column |
| 10. | Ultraviolet Ray Absorbers | " | Page 649, right column to page 650, left column |
| 11. | Antistaining Agents | Page 25, right column | Pae 650, left column to right column |
| 12. | Dye Image Stabilizers | Page 25 | — |
| 13. | Hardeners | Page 26 | Page 651, left column |
| 14. | Binders | Page 26 | " |
| 15. | Plasticizers and Lubricants | Page 27 | Page 650, right column |
| 16. | Coating Aids and Surfactants | Pages 26 to 27 | " |
| 17. | Antistatic Agents | Page 27 | " |

In the present invention, various color couplers can be employed and specific examples thereof are described in the patents cited in *Research Disclosure,* RD No. 17643, "VII-C" to "VII-G" as mentioned above. As dye forming couplers, couplers capable of providing three primary colors (i.e., yellow, magenta and cyan) in the subtractive color process upon color development are important. Specific examples of preferred diffusion-resistant, four-equivalent or two-equivalent couplers are described in the patents cited in *Research Disclosure,* RD No. 17643, "VII-C" and "VII-D" as mentioned above. In addition, couplers as described below are preferably employed in the present invention.

As typical yellow couplers used in the present invention, known yellow couplers of oxygen atom releasing type and known yellow couplers of nitrogen atom releasing type are exemplified. α-Pivaloylacetanilide type couplers are characterized by excellent fastness, particularly light fastness, of the dyes formed, and β-benzoylacetanilide type couplers are characterized by providing high color density.

As magenta couplers used in the present invention, hydrophobic 5-pyrazolone type couplers and pyrazoloazole type couplers each having a ballast group may be employed together with the magenta dye forming coupler according to the present invention. Of 5-pyrazolone type couplers, those substituted with an arylamino group or an acylamino group at the 3-position thereof are preferred in view of hue and color density of dyes formed therefrom.

As cyan couplers used in the present invention, hydrophobic and diffusion-resistant naphthol type and phenol type couplers are exemplified. Typical examples thereof preferably include oxygen atom releasing type two-equivalent naphthol type couplers.

Cyan couplers capable of forming cyan dyes fast to humidity and temperature are preferably used in the present invention. Typical examples thereof include phenol type cyan couplers having an alkyl group more than an ethyl group at the meta-position of the phenol nucleus as described in U.S. Pat. No. 3,772,002, 2,5-diacylamino-substituted phenol type couplers, phenol type couplers having a phenylureido group at the 2-position thereof and an acylamino group at the 5-position thereof, and 5-amidonaphthol type cyan couplers as described in European Patent No. 161,626A, etc.

Further, couplers capable of forming appropriately diffusible dyes can be used together in order to improve graininess. Specific examples of such types of magenta couplers are described in U.S. Pat. No. 4,336,237, etc. and those of yellow, magenta and cyan couplers are described in European Patent No. 96,570, etc.

Dye forming couplers and special couplers as described above may form polymers including dimers or high polymers. Typical examples of polymerized dye forming couplers are described in U.S. Pat. Nos. 3,451,820, etc. Specific examples of polymerized magenta couplers are described in U.S. Pat. No. 4,367,282, etc.

Couplers capable of releasing a photographically useful residue during the course of coupling can be also employed preferably in the present invention. Specific examples of useful DIR couplers capable of releasing a development inhibitor are described in the patents cited in *Research Disclosure,* RD No. 17643, "VII to F" described above.

In the photographic light-sensitive material according to the present invention, couplers which release imagewise a nucleating agent, a development accelerator or a precursor thereof at the time of development can be employed. Specific examples of such compounds are described in British Patent Nos. 2,097,140, 2,131,188, etc. Furthermore, DIR redox compound releasing couplers as described in Japanese patent application (OPI) No. 185950/85, etc., couplers capable of releasing a dye which turns to a colored form after being released as described in European Patent No. 173,302A, etc., may be employed in the photographic light-sensitive material of the present invention.

The coupler represented by formula (I), the compound represented by formula (II) and couplers used together in the present invention can be introduced into the photographic light-sensitive material according to various known dispersing methods. Specific examples of the organic solvents having a high boiling point which can be employed in an oil drop in water type dispersion method are described in U.S. Pat. No. 2,322,027, etc.

The processes and effects of latex dispersing methods and the specific examples of latexes for impregnation are described in U.S. Pat. No. 4,199,363, West German patent application (OLS) Nos. 2,541,274 and 2,541,230, etc.

The present invention is explained in greater detail with reference to the following examples, but the present invention should not be construed as being limited thereto.

EXAMPLE 1

On a cellulose triacetate film support provided with a subbing layer were coated layers having the compositions shown below to prepare a multilayer color light-sensitive material.

Regarding the compositions of the layers, coated amounts of silver halide and colloidal silver are shown by a silver coated amount in a unit of g/m$^2$, those of couplers, additives and gelatin are shown using a unit of g/m$^2$, and those of sensitizing dyes are shown using a molar amount per mol of silver halide present in the same layer.

| | |
|---|---|
| First Layer: Antihalation Layer | |
| Black colloidal silver | 0.2 |
| Gelatin | 1.3 |
| Coupler C-1 | 0.06 |
| Ultraviolet Ray Absorbing Agent UV-1 | 0.1 |
| Ultraviolet Ray Absorbing Agent UV-2 | 0.2 |
| Dispersion oil, Oil-1 | 0.01 |
| Dispersion oil, Oil-2 | 0.01 |
| Second Layer: Interlayer | |
| Fine grain silver bromide (average grain size: 0.07 μm) | 0.15 |
| Gelatin | 1.0 |
| Coupler C-2 | 0.02 |
| Dispersion oil, Oil-1 | 0.1 |
| Third Layer: First Red-Sensitive Emulsion Layer | |
| Silver iodobromide emulsion (silver iodide: 2 mol %, diameter/thickness ratio: 2.5, average grain size: 0.3 μm, high AgI in interior type) | 0.4 (as silver) |
| Gelatin | 0.6 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.06 |
| Coupler C-4 | 0.06 |
| Coupler C-8 | 0.04 |
| Coupler C-2 | 0.03 |
| Dispersion Oil, Oil-1 | 0.03 |
| Dispersion Oil, Oil-3 | 0.012 |
| Fourth Layer: Second Red-Sensitive Emulsion Layer | |
| Silver iodobromide emulsion (silver iodide: 5 mol %, diameter/thickness ratio: 4.0, average grain size: 0.7 μm, high AgI in interior type) | 0.7 (as silver) |
| Gelatin | 0.8 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersion Oil, Oil-1 | 0.15 |
| Dispersion Oil, Oil-3 | 0.02 |
| Fifth Layer: Third Red-Sensitive Emulsion Layer | |
| Silver iodobromide emulsion (silver iodide: 10 mol %, diameter/thickness ratio: 1.3, average grain size: 0.8 μm, high AgI in interior type) | 1.0 (as silver) |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 |
| Coupler C-7 | 0.1 |
| Dispersion oil, Oil-1 | 0.01 |
| Dispersion Oil, Oil-2 | 0.05 |
| Sixth Layer: Interlayer | |
| Gelatin | 1.0 |
| Compound Cpd-A | 0.03 |
| Dispersion Oil, Oil-1 | 0.05 |
| Seventh Layer: First Green-Sensitive Emulsion Layer | |
| Silver iodobromide emulsion (silver iodide: 2 mol %, diameter/thickness ratio: 2.5, average grain size: 0.3 μm, high AgI in interior type) | 0.3 (as silver) |
| Sensitizing Dye IV | $1 \times 10^{-4}$ |
| Sensitizing Dye V | $2 \times 10^{-4}$ |
| Sensitizing Dye VI | $0.3 \times 10^{-4}$ |
| Gelatin | 1.0 |
| Coupler C-11 | 0.2 |
| Coupler C-5 | 0.03 |
| Coupler C-1 | 0.03 |
| Dispersion Oil, Oil-1 | 0.5 |
| Eighth Layer: Second Green-Sensitive Emulsion Layer | |
| Silver iodobromide emulsion (silver iodide: 4 mol %, diameter/thickness ratio: 4.0, average grain size: 0.6 μm, high AgI in interior type) | 0.4 (as silver) |
| Gelatin | 1.0 |
| Sensitizing Dye IV | $5 \times 10^{-4}$ |
| Sensitizing Dye V | $2 \times 10^{-4}$ |
| Sensitizing Dye VI | $0.3 \times 10^{-4}$ |
| Coupler C-11 | 0.25 |
| Coupler C-1 | 0.03 |
| Coupler C-9 | 0.015 |
| Coupler C-5 | 0.01 |
| Dispersion Oil, Oil-1 | 0.2 |
| Ninth Layer: Third Green-Sensitive Emulsion Layer | |
| Silver iodobromide emulsion (silver iodide: 6 mol %, diameter/thickness ratio: 1.2, average grain size: 1.0 μm, high AgI in interior type) | 0.85 (as silver) |
| Gelatin | 1.0 |
| Sensitizing Dye VII | $3.5 \times 10^{-4}$ |
| Sensitizing Dye VIII | $1.4 \times 10^{-4}$ |
| Coupler C-11 | 0.10 |
| Coupler C-1 | 0.02 |
| Coupler C-13 | 0.02 |

-continued

| | |
|---|---|
| Dispersion Oil, Oil-1 | 0.20 |
| Dispersion Oil, Oil-2 | 0.05 |
| Tenth layer: Yellow Filter Layer | |
| Gelatin | 1.2 |
| Yellow Colloidal silver | 0.08 |
| Compound Cpd-B | 0.1 |
| Dispersion Oil, Oil-1 | 0.3 |
| Eleventh Layer: First Blue-Sensitive Emulsion Layer | |
| Monodispersed silver iodobromide emulsion (silver iodide: 4 mol %, diameter/thickness ratio: 1.5, average grain size: 0.5 μm, high AgI in interior type) | 0.4 (as silver) |
| Gelatin | 1.0 |
| Sensitizing Dye IX | $2 \times 10^{-4}$ |
| Coupler C-12 | 0.9 |
| Coupler C-5 | 0.07 |
| Dispersion Oil, Oil-1 | 0.2 |
| Twelfth Layer: Third Green-Sensitive Emulsion Layer | |
| Silver iodobromide emulsion (silver iodide: 10 mol %, diameter/thickness ratio: 4.5, average grain size: 1.3 μm, high AgI in interior type) | 0.4 (as silver) |
| Gelatin | 0.6 |
| Sensitizing Dye IX | $1 \times 10^{-4}$ |
| Coupler C-12 | 0.25 |
| Dispersion Oil, Oil-1 | 0.07 |
| Thirteenth Layer: First Protective Layer | |
| Gelatin | 0.8 |
| Ultraviolet Ray Absorbing Agent UV-1 | 0.1 |
| Ultraviolet Ray Absorbing Agent UV-2 | 0.2 |
| Dispersion Oil, Oil-1 | 0.01 |
| Dispersion Oil, Oil-2 | 0.01 |
| Fourteenth Layer: Second Protective Layer | |
| Fine grain silver bromide (average grain size: 0.07 μm) | 0.5 |
| Gelatin | 0.45 |
| Polymethyl methacrylate particle (diameter: 1.5 μm) | 0.2 |
| Hardening Agent H-1 | 0.4 |
| n-Butyl p-hydroxybenzoate | 0.012 |
| Formaldehyde Scavenger S-1 | 0.5 |
| Formaldehyde Scavenger S-2 | 0.5 |

A surface active agent was added to each of the layers as a coating aid in addition to the above described components.

The chemical structural formulae or chemical names of the compounds employed in this example are shown below.

UV-1

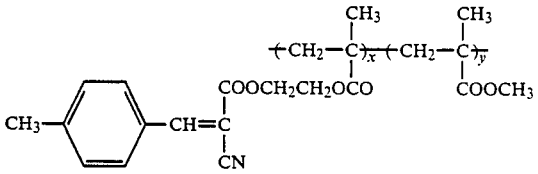

where x/y=7/3 (in weight ratio)

UV-2

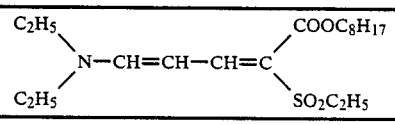

| | |
|---|---|
| Oil-1 | Tricresyl phosphate |
| Oil-2 | Dibutyl phthalate |
| Oil-3 | Bis(2-ethylhexyl) phthalate |

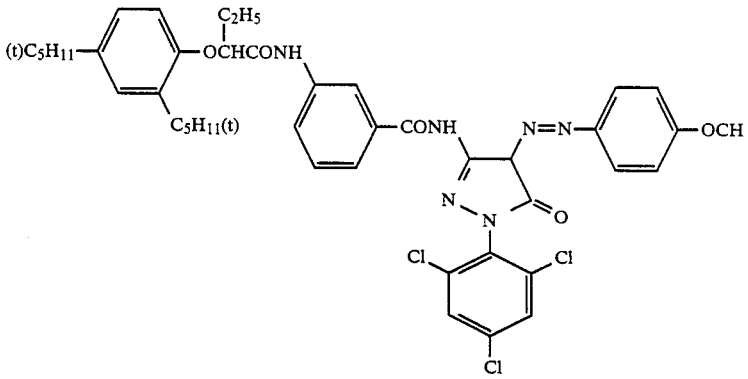

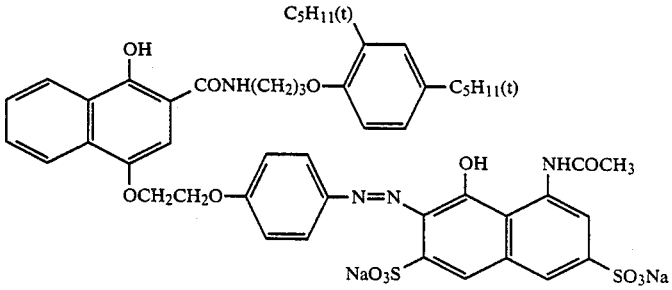

-continued
C-3
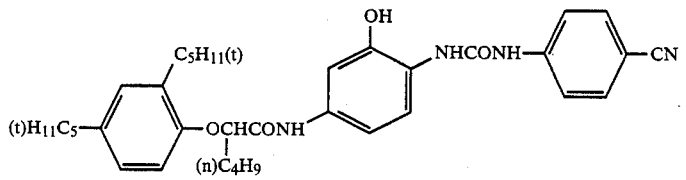
C-4
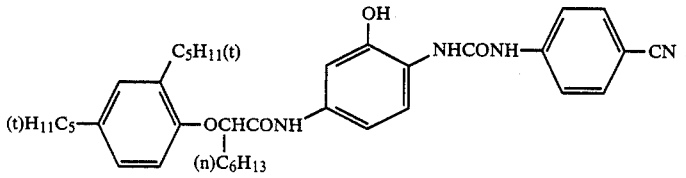
C-5
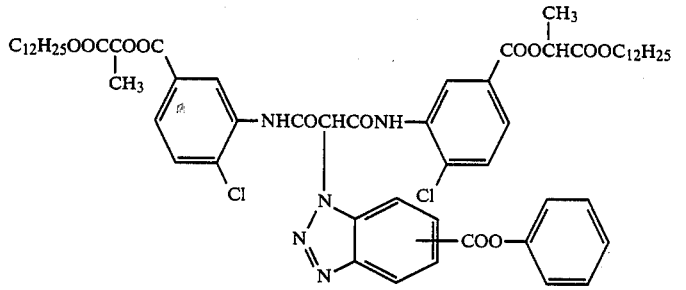
C-6
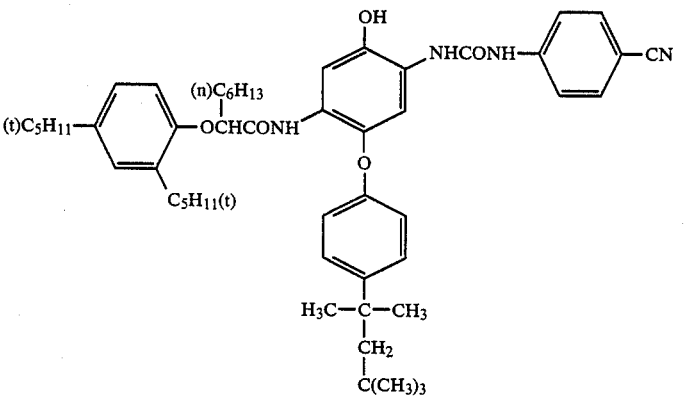
C-7
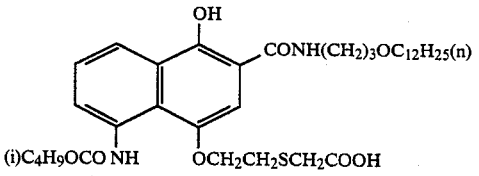
C-8
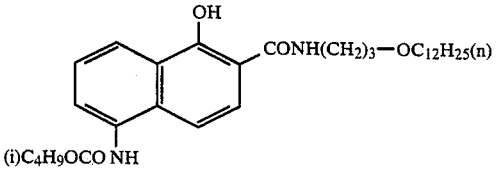

-continued
C-9
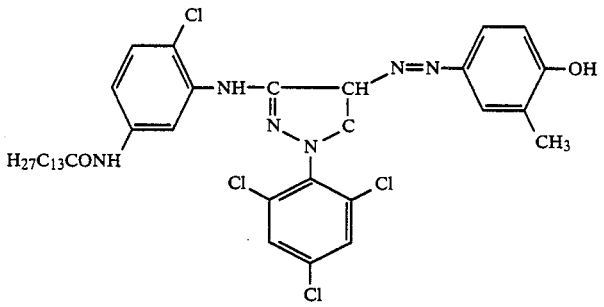
C-10
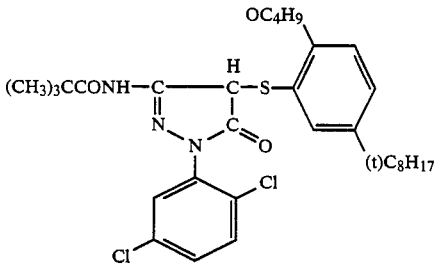
C-11
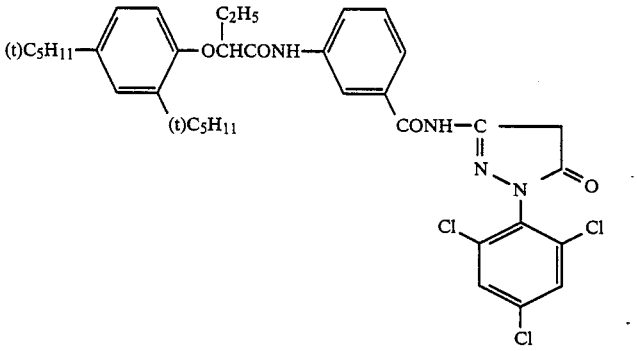
C-12
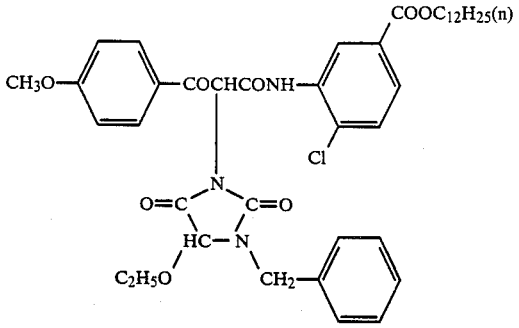
C-13
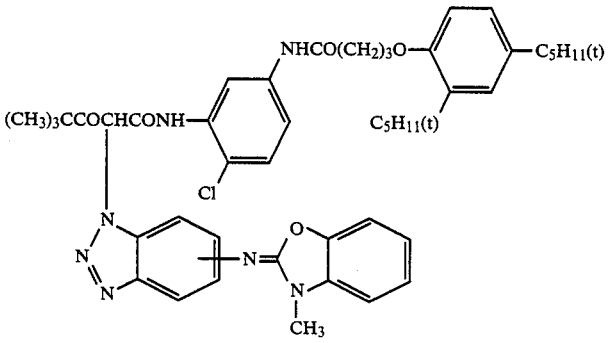

-continued
Cpd-A
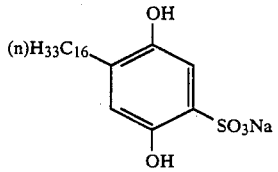
Cpd-B
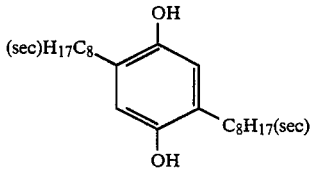
Sensitizing Dye I
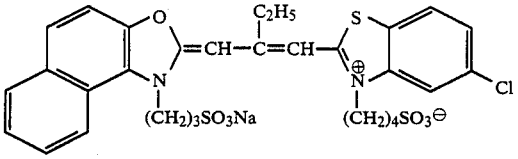
Sensitizing Dye II
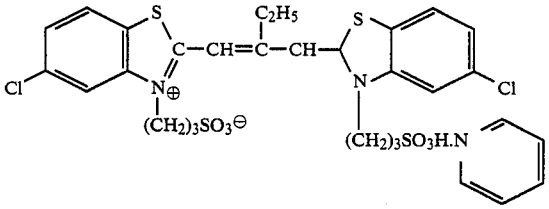
Sensitizing Dye III
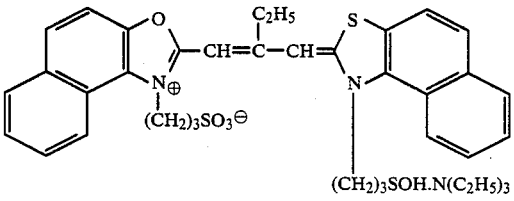
Sensitizing Dye IV
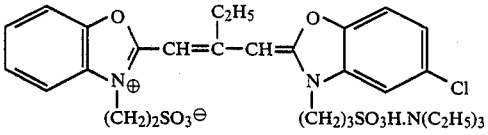
Sensitizing Dye V
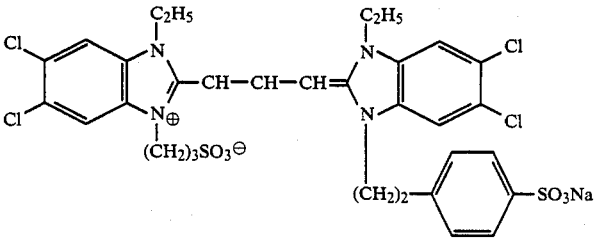
Sensitizing Dye VI
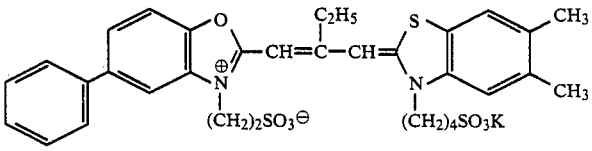

-continued

Sensitizing Dye VII

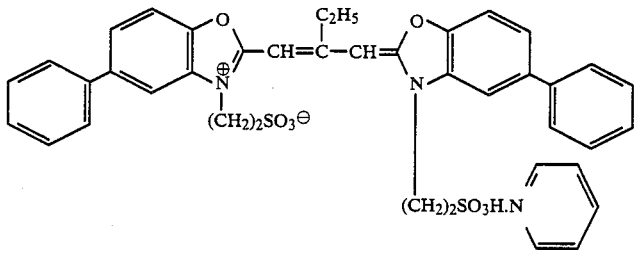

Sensitizing Dye VIII

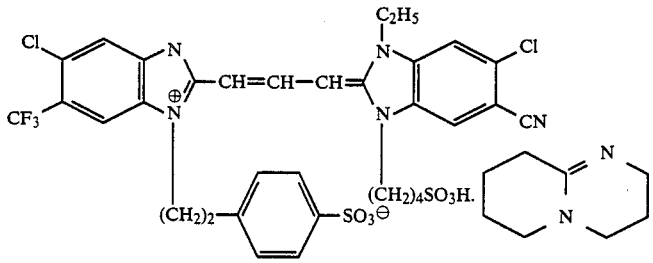

Sensitizing Dye IX

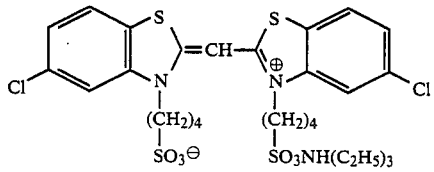

H-1

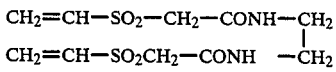

S-1

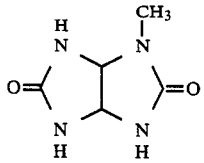

S-2

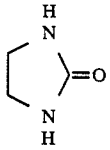

The samples thus prepared was designated as Sample 101.

Sample 102 was prepared in the same manner as described for Sample 101 except using a silver iodobromide emulsion containing 0.5 mol % of silver iodide in each layer.

Samples 103 and 104 were prepared in the same manner as described for Sample 101 except that Coupler C-11 used in the seventh, eighth and ninth layers were substituted with 0.6 times mol of Couplers (M-5) and (M-27) according to the present invention, respectively. Also, Samples 105 and 106 were prepared in the same manner as described for Sample 102 except that the Coupler used in the seventh, eighth and ninth layers were substituted with 0.6 times mol of Couplers (M-5) and (M-27) according to the present invention, respectively.

Further, Samples 107 to 110 were prepared in the same manner as described for Samples 103 to 106, respectively, except that Compound (A-5) according to the present invention was added to the seventh, eighth and ninth layers in an amount of 0.012 g/m$^2$, respectively.

The multilayer color photographic light-sensitive materials thus prepared were each cut-through to 35 m/m width, and imagewise exposed normally to take outdoor photographs. Thereafter, the development and processing were conducted at 38° C. in accordance with the following processing steps using an automatic developing machine.

| Step | Time | Tank Capacity (l) |
|---|---|---|
| Color Development | 3 min 15 sec | 10 |
| Bleaching | 6 min 30 sec | 4 |
| Fixing | 4 min 20 sec | 10 |
| Washing with water | 3 min 15 sec | 8 |

-continued

| Step | Time | Tank Capacity (l) |
|---|---|---|
| Stabilizing | 1 min 5 sec | 4 |

The compositions of the processing solutions used in the respective steps were as follows.

Color Developing Solution:

The compositions of the mother solution (i.e., mother liquor) and the replenisher were as follows.

| | Mother Solution | Replenisher |
|---|---|---|
| Diethylenetriaminepentaacetic acid | 2.0 g | 2.0 g |
| 1-Hydroxyethylidene-1,1-diphosphonic Acid | 3.3 g | 3.3 g |
| Sodium Sulfite | 4.0 g | 4.7 g |
| Potassium Carbonate | 30.0 g | 30.0 g |
| Potassium Bromide | 1.4 g | 0.3 g |
| Potassium Iodide | 1.3 mg | 0 |
| Hydroxylamine Sulfate | 2.4 g | 3.5 g |
| 4-(N—Ethyl-N—β-hydroxyethylamino)-2-methylaniline Sulfate | 4.5 g | 7.0 g |
| Water to make | 1.0 l | 1.0 l |
| pH | 10.0 | 10.1 |

The amount of replenisher was added at a rate of 600 ml/m$^2$, and pH adjustment was carried out by using potassium hydroxide or sulfuric acid.

| | |
|---|---|
| Bleaching Solution: (both mother solution and replenisher) | |
| Ammonium Fe(III) Ethylenediaminetetraacetate | 120.0 g |
| Disodium Ethylenediaminetetraacetate | 10.0 g |
| Ammonium Bromide | 150.0 g |
| Ammonium Nitrate | 10.0 g |
| Water to make | 1.0 l |
| pH | 6.0 |
| Fixing Solution: (both mother solution and replenisher) | |
| Disodium Ethylenediaminetetraacetate | 1.0 g |
| Sodium Sulfite | 4.0 g |
| Ammonium Thiosulfate (700 g/l aq. formaldehyde soln.) | 200.0 ml |
| Sodium Bisulfite | 4.6 g |
| Water to make | 1.0 l |
| pH | 6.6 |
| Stabilizing Solution: (both mother solution and replenisher) | |
| Formalin (37 wt % aq. soln.) | 2.0 ml |
| Polyoxyethylene-p-monononyl Phenyl Ether (average degree of polymerization: about 10) | 0.3 g |
| Water to make | 1.0 l |

The replenisher for bleaching solution was replenished at a rate of 1,000 ml/m$^2$, the replenisher for fixing solution was replenished in a rate of 1,000 ml/m$^2$ and the replenisher for stabilizing solution was replenished at a rate of 1,000 ml/m$^2$. In the water washing bath, water was added at a rate of 15,000 ml/m$^2$.

In the manner as described above, 500 m of each sample (35 mm width) was run-processed continuously, and magenta dye densities of each sample were measured at the start of the processing and the end of the running process. The difference in gradation (absolute gamma difference $|\Delta\gamma|$) between the start of the processing and the end of the running process was evaluated as the representative characteristic. The results obtained are shown in Table 1 below.

TABLE 1

| No. | Sample | Magenta Coupler of Present Invention | Compound of Present Invention | Gradation Difference in Magenta Density ($\lvert\Delta\gamma\rvert$) | Precipitate in Developing Solution |
|---|---|---|---|---|---|
| 1 (comparison) | 101 | — | — | 0.13 | absent |
| 2 (comparison) | 102 | — | — | 0.18 | present |
| 3 (comparison) | 103 | M-5 | — | 0.8 | absent |
| 4 (comparison) | 104 | M-27 | — | 0.07 | absent |
| 5 (comparison) | 105 | M-5 | — | 0.12 | present |
| 6 (comparison) | 106 | M-27 | — | 0.11 | present |
| 7 (present Invention) | 109 | M-5 | A-5 | 0.05 | slightly present |
| 8 (present Invention) | 110 | M-27 | A-5 | 0.05 | slightly present |
| 9 (present Invention) | 107 | M-5 | A-5 | 0.02 | absent |
| 10 (present Invention) | 108 | M-27 | A-5 | 0.03 | absent |

$|\Delta\gamma|$ is an average value of from the minimum density + 0.3 to the minimum density + 1.2.

It is apparent from the results shown in Table 1 that the method of the present invention is excellent in processing stability and prevents from the formation of precipitate in the color developing solution.

EXAMPLE 2

Samples 111 and 112 were prepared in the same manner as described for Samples 107 and 108, respectively, except the Compound (A-6) according to the present invention was added to the seventh, eighth and ninth layers in an amount of 0.012 g/m$^2$, respectively.

Samples 101, 103, 104, 109, 111 and 112 were each subjected to running processing in the same manner as described in Example 1 using an automatic developing machine in accordance with the following processing steps.

| Processing Step | Processing Time | Processing Temperature | Amount of*1 Replenishment | Capacity of Tank |
|---|---|---|---|---|
| Color Development | 3 min. 15 sec. | 38° C. | shown in Table 2 below | 10 l |
| Bleaching | 1 min. 00 sec. | 38° C. | 20 ml | 4 l |
| Bleach-Fixing | 3 min. 15 sec. | 38° C. | 30 ml | 8 l |
| Washing with Water (1) | 40 sec. | 35° C. | *2 | 4 l |
| Washing with Water (2) | 1 min. 00 sec. | 35° C. | 30 ml | 4 l |
| Stabilizing | 40 sec. | 38° C. | 20 ml | 4 l |
| Drying | 1 min. 15 sec. | 55° C. | — | — |

*1Amount of replenishment per 1 meter of 35 mm width strip

*2The washing with water steps were carried out using a countercurrent piping system from Washing with Water (2) to Washing with Water (1).

The composition of each processing solution used is illustrated below.

| Color Developing Solution: | Mother Solution | Replenisher |
|---|---|---|
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.1 g |
| Potassium Iodide | 1.5 mg | — |
| Hydroxylamine Sulfate | 2.4 g | 2.8 g |
| 4-(N—Ethyl-N—β-hydroxyethylamino)-2-methylaniline Sulfate | 4.5 g | 5.5 g |
| Water to make | 1.0 l | 1.0 l |
| pH | 10.05 | 10.10 |

| Bleaching Solution: (both mother solution and replenisher) | |
|---|---|
| Ammonium Fe(III) Ethylenediaminetetraacetate Dihydrate | 120.0 g |
| Disodium Ethylenediaminetetraacetate | 10.0 g |
| Ammonium Bromide | 100.0 g |
| Ammonium Nitrate | 10.0 g |
| Bleach Accelerating Agent: | 0.005 mol |

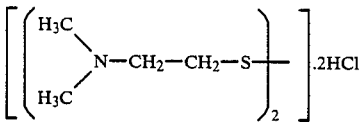

| | |
|---|---|
| Aqueous Ammonia (27 wt %) | 15.0 ml |
| Water to make | 1.0 l |
| pH | 6.3 |

| Bleach-Fixing Solution: | Mother Solution | Replenisher |
|---|---|---|
| Ammonium Iron (III) Ethylenediaminetetraacetate Dihydrate | 50.0 g | — |
| Disodium Ethylenediaminetetraacetate | 5.0 g | 0.5 g |
| Sodium Sulfite | 12.0 g | 20.0 g |
| Aqueous Solution of Ammonium Thiosulfate (700 g/l eq. soln) | 240.0 ml | 400.0 ml |
| Aqueous ammonia (27 wt %) | 6.0 ml | — |
| Water to make | 1.0 l | 1.0 l |
| pH | 7.2 | 8.0 |

| Stabilizing Solution: (both mother solution and replenisher) | |
|---|---|
| Formalin (37 wt %) | 2.0 ml |
| Polyoxyethylene-p-monononyl Phenyl Ether (average degree of polymerization: about 10) | 0.3 g |
| Disodium Ethylenediaminetetraacetate | 0.05 g |
| Water to make | 1.0 l |
| pH | 5.8 to 8.0 |

Washing water employed was as follows.

City water (containing calcium: 30 mg/l and magnesium: 8 mg/l) was passed through a mixed bed type column filled with 400 ml of an H type strong acidic cationic exchange rein (Amberlite IR-120B manufactured by Rohm & Haas Co.) and 600 ml of an OH type anionic exchange resin (Amberlite IR-400 manufactured by Rohm & Haas Co.) at a rate of 3 liters per minute to reduce both calcium ions and magnesium ions at concentrations shown below. The thus-treated water was used as mother solution and replenisher.

| | |
|---|---|
| Calcium | 3 mg/liter |
| Magnesium | 2 mg/liter |

Further, to a tank for the replenisher were added sodium dichloroisocyanurate in an amount of 20 mg per liter and sodium sulfate in an amount of 0.15 g per liter.

The results thus obtained are shown in Table 2 below. The results were evaluated in the same manner as described in Example 1.

TABLE 2

| No. | Amount of Replenishment (ml/m²) | Sample | Magenta Coupler of Present Invention | Compound of Present Invention | Gradation Difference in Magenta Density \|Δγ\| | Precipitate in Developing Solution |
|---|---|---|---|---|---|---|
| 1 (comparison) | 1500 | 101 | — | — | 0.20 | absent |
| 2 (comparison) | 1500 | 104 | M-27 | — | 0.16 | absent |
| 3 (comparison) | 1500 | 112 | M-27 | A-6 | 0.10 | absent |
| 4 (comparison) | 900 | 103 | M-5 | — | 0.13 | absent |
| 5 (present invention) | 900 | 111 | M-5 | A-6 | 0.04 | absent |
| 6 | 500 | 101 | — | — | 0.09 | present |

TABLE 2-continued

| No. | Amount of Replenishment (ml/m²) | Sample | Magenta Coupler of Present Invention | Compound of Present Invention | Gradation Difference in Magenta Density \|Δγ\| | Precipitate in Developing Solution |
|---|---|---|---|---|---|---|
| (comparison) | | | | | | |
| 7 (present invention) | 500 | 109 | M-5 | A-5 | 0.03 | slightly present |
| 8 (present invention) | 500 | 111 | M-5 | A-6 | 0.02 | absent |
| 9 (present invention) | 500 | 112 | M-27 | A-6 | 0.01 | absent |

It is apparent from the results shown in Table 2 that in Nos. 1 to 4, although the precipitate is not formed in the developing solution, the change in gradation becomes large due to the running process. On the contrary, No. 7 shows a small change in gradation and only slight formation of the precipitate in the developing solution. Also, in Nos. 5, 8 and 9, the precipitate is not formed and the change in gradation is small.

EXAMPLE 3

300 meters of each sample as shown in Table 3 below was processed using an automatic developing machine (modified Fuji Color Negative Processor FP 350) in accordance with the following processing steps. The exposure of the samples was conducted in the same manner as described in Example 1.

| Processing Step | Processing Time | Processing Temperature | Amount of*1 Replenishment | Capacity of Tank |
|---|---|---|---|---|
| Color Development | 2 min. 30 sec. | 40° C. | shown in Table 3 below | 8 l |
| Bleach-Fixing | 3 min. 00 sec. | 40° C. | 20 ml | 8 l |
| Washing with Water (1) | 20 sec. | 35° C. | *2 | 2 l |
| Washing with Water (2) | 20 sec. | 35° C. | 10 ml | 2 l |
| Stabilizing | 20 sec. | 35° C. | 10 ml | 2 l |
| Drying | 50 sec. | 65° C. | — | — |

*1Amount of replenishment per 1 meter of 35 mm width strip
*2The washing with water steps were carried out using a countercurrent piping system from Washing with Water (2) to Washing with Water (1).

In the above described processing steps, the whole overflow solution which was overflowed from Washing with Water (1) resulted from the replenishment was introduced into the bleach-fixing bath.

The composition of each processing solution used is illustrated below.

| Color Developing Solution: | Mother Solution | Replenisher |
|---|---|---|
| Diethylenetriaminepentaacetic Acid | 2.0 g | 2.2 g |
| 1-Hydroxyethylidene-1,1-diphosphonic Acid | 3.0 g | 3.2 g |
| Sodium Sulfite | 4.0 g | 5.5 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 g | 3.0 g |

-continued

| | | |
|---|---|---|
| 4-(N—Ethyl-N—β-hydroxyethylamino)-2-methylaniline Sulfate | 4.5 g | 7.5 g |
| Water to make | 1.0 l | 1.0 l |
| pH | 10.05 | 10.20 |

| Bleach-Fixing Solution: (both mother solution and replenisher) | |
|---|---|
| Ammonium Iron (III) Ethylenediaminetetraacetate Dihydrate | 80.0 g |
| Disodium Ethylenediaminetetraacetate | 5.0 g |
| Sodium Sulfite | 12.0 g |
| Ammonium Thiosulfate (700 g/l aq. soln.) | 260.0 ml |
| Ammonium Bromide | 100.0 g |
| Acetic Acid (98 wt %) | 5.0 ml |
| Bleach Accelerating Agent | 0.01 mol |

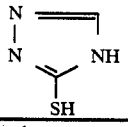

| | |
|---|---|
| Water to make | 1.0 l |
| pH | 6.0 |

| Stabilizing Solution: (both mother solution and replenisher) | |
|---|---|
| Formalin (37 wt % aq. soln.) | 2.0 ml |
| Polyoxyethylene-p-monononyl Phenyl Ether (average degree of polymerization = 10) | 0.3 g |
| Disodium Ethylenediaminetetraacetate | 0.05 g |
| Water to make | 1.0 l |
| pH | 5.0 to 8.0 |

The washing water used was the same as described in Example 2.

The results thus obtained are shown in Table 3 below. The results were evaluated in the same manner as described in Example 1.

TABLE 3

| No. | Amount of Replenishment (ml/m²) | Sample | Magenta Coupler of Present Invention | Compound of Present Invention | Gradation Difference in Magenta Density (\|Δγ\|) | Precipitate in Developing Solution |
|---|---|---|---|---|---|---|
| 1 (comparison) | 1500 | 102 | — | — | 0.23 | present |

TABLE 3-continued

| No. | Amount of Replenishment (ml/m²) | Sample | Magenta Coupler of Present Invention | Compound of Present Invention | Gradation Difference in Magenta Density (\|Δγ\|) | Precipitate in Developing Solution |
|---|---|---|---|---|---|---|
| 2 (comparison) | 1500 | 107 | M-5 | A-5 | 0.13 | absent |
| 3 (comparison) | 700 | 105 | M-5 | — | 0.11 | present |
| 4 (present invention) | 700 | 107 | M-5 | A-5 | 0.04 | absent |
| 5 (comparison) | 500 | 102 | — | — | 0.10 | present |
| 6 (present invention) | 500 | 107 | M-5 | A-5 | 0.04 | absent |
| 7 (present invention) | 500 | 112 | M-27 | A-6 | 0.03 | absent |
| 8 (comparison) | 350 | 102 | — | — | 0.13 | present |
| 9 (present invention) | 350 | 111 | M-5 | A-6 | 0.02 | absent |
| 10 (present invention) | 350 | 112 | M-27 | A-6 | 0.01 | absent |

It is apparent from the results shown in Table 3 that according to the processing method of the present invention, the precipitate is not formed in the developing solution and the change in gradation due to the running process is hardly observed, even when the color developing time is shortened.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising a support having thereon at least one silver halide emulsion layer and containing a magenta dye forming coupler represented by formula (I) shown below and a compound represented by formula (II) shown below in the same layer, wherein the silver halide color photographic material is subjected to color development using a replenisher for a color developing solution, whose concentration of bromide is not more than $3\times10^{-3}$ mol per liter and an amount of the replenisher for a color developing solution is not more than 900 ml per m² of the silver halide color photographic material, wherein formula (I) is represented by

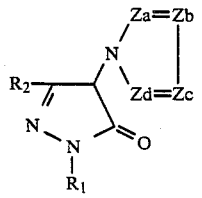

(I)

wherein $R_1$ represents an aromatic group, an aliphatic group or a heterocyclic group; $R_2$ represents a substituent; Za, Zb, Zc and Zd, which may be the same or different, each represents an unsubstituted methine group, a substituted methine group or —N=; and formula (II) is represented by $$(R'—COO^-)_n M^{n+} \quad (II)$$

wherein R′ represents a substituent which imparts a diffusion-resistant property to the compound represented by formula (II); $M^{n+}$ represents a hydrogen ion, a metal ion, or an ammonium ion; and n represents an integer from 1 to 4.

2. A method for processing a silver halide color photographic material as claimed in claim 1, wherein $R_1$ represents a straight chain or branched chain alkyl group having from 1 to 32 carbon atoms, an alkenyl group, a cyclic alkyl group, an aralkyl group or a cyclic alkenyl group, each of which may be substituted with a substituent selected from a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, aralkylsulfonyl group, an arylthio group, an alkylthio group, an alkylamino group, a dialkylamino group, an anilino group, an N-arylanilino group, an N-alkylanilino group, an N-acylanilino group, a hydroxy group and a mercapto group; an aryl group, which may be substituted with a substituent selected from an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group and a mercapto group; a heterocyclic group, which may be substituted with a substituent selected from the substituents as defined for the above-described aryl group; an aliphatic acyl group; an aromatic acyl group; alkylsulfonyl group; an arylsulfonyl group; an alkylcarbamoyl group; an alkylcarbamoyl group; an arylcarbamoyl group; an alkylthiocarbamoyl group; or an arylthiocarbamoyl group; and $R_2$ represents a hydrogen atom; a straight chain or branched chain alkyl group having from 1 to 32 carbon atoms, an alkenyl group, a cyclic alkyl group, an aralkyl group, a cyclic alkenyl group, an aryl group or a heterocyclic group, each of which may be substituted with a substituent selected from the substituent as defined for these groups of $R_1$ respectively; an alkoxycarbonyl group; an aryloxycarbonyl group; an aralkyloxycarbonyl group; an alkoxy group; an aryloxy group; an alkylthio group; an arylthio group; a carboxy group; an acylamino group; a diacylamino group; N-alkylacylamino group; an N-arylacylamino group; a ureido group; a thioureido group; a urethane group; a thiourethane group; an arylamino group; an alkylamino group, a cycloamino group; a heterocyclic amino group; an alkylcarbonyl group; an arylcarbonyl group; a sulfonamido group; a carbamoyl group; a sulfamoyl group; an acyloxy group; a sulfonyloxy group; a cyano group; a hydroxy group; a mercapto group; a halogen atom; a nitro group; or a sulfo group.

3. A method for processing a silver halide color photographic material as claimed in claim 1, wherein $R_1$ represents a phenyl group which is substituted with an alkyl group, an alkoxy group or a halogen atom at at least one of the o-positions.

4. A method for processing a silver halide color photographic material as claimed in claim 1, wherein $R_2$ represents an anilino group, an acylamino group or arylureido group; and $R_1$ represents an aryl group which is substituted with a chlorine atom at at least one of the o-positions.

5. A method for processing a silver halide color photographic material as claimed in claim 1, wherein the nitrogen containing ring composed of Za, Zb, Zc and Zd may further have a condensed ring excepting a benzotriazolyl-1 group and a benzotriazolyl-2 group.

6. A method for processing a silver halide color photographic material as claimed in claim 1, wherein (1) the group of the formula

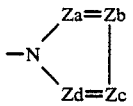

of formula (I) represents a 5-membered monocyclic nitrogen-containing aromatic heterocyclic group which is composed of Za, Zb, Zc and Zd that each represents a methine group, a substituted methine group or —N=, or (2) the group of the formula

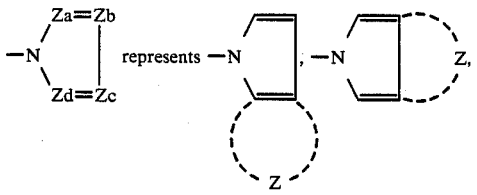

-continued

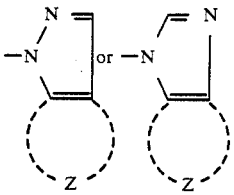

wherein Z represents a non-metallic atomic group forming a 5-membered or 6-membered ring.

7. A method for processing a silver halide color photographic material as claimed in claim 1, wherein the substituent represented by R, has from 8 to 40 carbon atoms in total and represents a straight chain or branched chain alkyl group, an alkenyl group, a cyclic alkyl group, an aralkyl group or a cyclic alkenyl group, each of which may be substituted with a substituent selected from a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group and a mercapto group; an aryl group which may be substituted with a substituent selected from an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, dialkylamino group, an anilino group, an N-alkylanilino group, an N-arylanilino group, an N-acylanilino group, a hydroxy group and a mercapto group; a heterocyclic group which may be substituted with a substituent selected from the substituents as defined for the above-described aryl group; an aliphatic acyl group; an aromatic acyl group; alkylsulfonyl group; an arylsulfonyl group; an alkylcarbamoyl group; an arylcarbamoyl group; an alkylthiocarbamoyl group; or an arylthiocarbamoyl group.

8. A method for processing a silver halide color photographic material as claimed in claim 1, wherein the metal ion represented by $M^{n+}$ is selected from ions of the group I, the group II and the group VIII of the Periodic Table.

9. A method for processing a silver halide color photographic material as claimed in claim 1, wherein the ammonium ion represented by $M^{n+}$ is represented by the following formula:

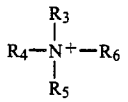

wherein $R_3$, $R_4$, $R_5$ and $R_6$, each represents a hydrogen atom, an alkyl group, a substituted alkyl group, aralkyl group, a substituted aralkyl group, an aryl group, a substituted aryl group, and the total number of carbon atoms included in $R_3$, $R_4$, $R_5$ and $R_6$ is up to 20; or each two of $R_3$ to $R_6$ are connected with each other to form a ring.

10. A method for processing a silver halide color photographic material as claimed in claim 9, wherein a substituent for the alkyl group, aralkyl group or aryl group is selected from a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group and a sulfonyl group.

11. A method for processing a silver halide color photographic material as claimed in claim 1, wherein $M^{n+}$ is selected from $H^+$, $Na^+$, $K^+$, and $NH_4^+$.

12. A method for processing a silver halide color photographic material as claimed in claim 1, wherein the amount of the compound represented by formula (II) is from 0.003 mol to 1 mol per mol of the magenta coupler represented by formula (I).

13. A method for processing a silver halide color photographic material as claimed in claim 1, wherein the layer containing the magenta coupler represented by formula (I) and the compound represented by formula (II) is a silver halide emulsion layer or a layer adjacent thereto.

14. A method for processing a silver halide color photographic material as claimed in claim 1, wherein the replenisher for a color developing solution contains bromide ount of not more than $2\times10^{-3}$ mol per liter, and the amount of the replenisher is from 50 ml/m$^2$ to 700 ml/m$^2$.

15. A method for processing a silver halide color photographic material as claimed in claim 1, wherein the replenisher for a color developing solution does not contain bromide at all, and the amount of the replenisher is from 100 ml/m$^2$ to 500 ml/m$^2$.

16. A method for processing a silver halide color photographic material as claimed in claim 1, wherein the color developing solution further contains a chelating agent represented by formula (III), (IV) or (V):

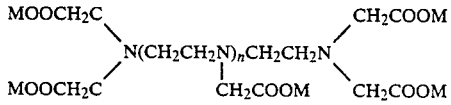

(III)

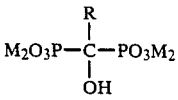

(IV)

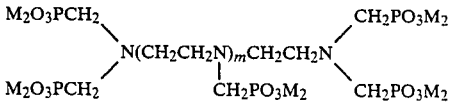

(V)

wherein n represents 1 or 2; m represents 0 or 1; R represents a lower alkyl group; and M which may be the same or different, each represents a hydrogen atom or alkali metal.

17. A method for processing a silver halide color photographic material as claimed in claim 1, wherein a processing time of the color development is from 40 seconds to 3 minutes.

* * * * *